US007954800B2

(12) United States Patent
Maeda et al.

(10) Patent No.: US 7,954,800 B2
(45) Date of Patent: Jun. 7, 2011

(54) OPENABLE SHEET PROCESSING DEVICE

(75) Inventors: Hiroshi Maeda, Aichi (JP); Masahiro Tamura, Kanagawa (JP); Nobuyoshi Suzuki, Tokyo (JP); Shuuya Nagasako, Kanagawa (JP); Naohiro Kikkawa, Kanagawa (JP); Kazuhiro Kobayashi, Kanagawa (JP); Tomohiro Furuhashi, Kanagawa (JP); Tomoichi Nomura, Aichi (JP); Makoto Hidaka, Tokyo (JP); Hitoshi Hattori, Tokyo (JP); Junichi Tokita, Kanagawa (JP); Akira Kunieda, Tokyo (JP); Ichiro Ichihashi, Aichi (JP)

(73) Assignee: Ricoh Company, Limited, Tokyo (JP)

( * ) Notice: Subject to any disclaimer, the term of this patent is extended or adjusted under 35 U.S.C. 154(b) by 285 days.

(21) Appl. No.: 12/222,443

(22) Filed: Aug. 8, 2008

(65) Prior Publication Data

US 2009/0057978 A1 Mar. 5, 2009

(30) Foreign Application Priority Data

Aug. 20, 2007 (JP) ..... 2007-214067
Jun. 13, 2008 (JP) ..... 2008-155526

(51) Int. Cl.
*B65H 37/04* (2006.01)

(52) U.S. Cl. ..... 270/58.11; 270/58.08; 270/58.09; 399/110; 399/410

(58) Field of Classification Search ..... 270/58.08, 270/58.09, 58.11; 399/124, 110, 407, 408, 399/410

See application file for complete search history.

(56) References Cited

U.S. PATENT DOCUMENTS

| | | | | |
|---|---|---|---|---|
| 5,895,036 | A * | 4/1999 | Asao | 270/58.09 |
| 5,971,384 | A * | 10/1999 | Asao | 270/58.13 |
| 6,062,557 | A * | 5/2000 | Kusumi | 271/10.13 |
| 6,824,128 | B2 * | 11/2004 | Nagata et al. | 270/58.08 |
| 7,137,944 | B2 * | 11/2006 | Suzuki et al. | 493/405 |
| 2006/0261544 | A1 | 11/2006 | Tamura et al. | |
| 2007/0051219 | A1 | 3/2007 | Tamura et al. | |
| 2007/0138726 | A1 | 6/2007 | Tamura et al. | |
| 2007/0147925 | A1 | 6/2007 | Nomura et al. | |
| 2007/0235917 | A1 | 10/2007 | Nagasako et al. | |
| 2008/0006993 | A1 | 1/2008 | Nomura et al. | |
| 2008/0048380 | A1 | 2/2008 | Ichihashi et al. | |
| 2008/0067730 | A1 | 3/2008 | Suzuki et al. | |

FOREIGN PATENT DOCUMENTS

| | | | |
|---|---|---|---|
| JP | 10-129920 | | 5/1998 |
| JP | 10129920 | A * | 5/1998 |
| JP | 2004045538 | A * | 2/2004 |
| JP | 2004-083184 | | 3/2004 |
| JP | 2005-187208 | | 7/2005 |
| JP | 2006-131399 | | 5/2006 |
| JP | 2006-273493 | | 10/2006 |
| JP | 2007246263 | A * | 9/2007 |

OTHER PUBLICATIONS

Office Action dated Feb. 12, 2010 for corresponding Chinese Application No. 200810130854.6 and English translation thereof.

* cited by examiner

*Primary Examiner* — Patrick Mackey
(74) *Attorney, Agent, or Firm* — Harness, Dickey & Pierce, P.L.C.

(57) ABSTRACT

A sheet processing device includes a sheet aligning unit that aligns a sheet recording medium. The sheet aligning unit is configured to be pulled out from a main body of the sheet processing device, and includes a sheet conveying member for conveying the sheet recording medium.

16 Claims, 34 Drawing Sheets

OPENABLE SHEET PROCESSING DEVICE

CROSS-REFERENCE TO RELATED APPLICATIONS

The present application claims priority to and incorporates by reference the entire contents of Japanese priority documents, 2007-214067 filed in Japan on Aug. 20, 2007 and Japanese priority document 2008-155526 filed in Japan on Jun. 13, 2008.

BACKGROUND OF THE INVENTION

1. Field of the Invention

The present invention relates to a sheet processing device including a sheet aligning unit that aligns a conveyed sheet recording medium (hereinafter, simply "a sheet"), an image forming apparatus including the sheet processing device, and an image forming system.

2. Description of the Related Art

In a typical sheet processing device including a sheet aligning unit such as a finisher, a processing tray as a sheet aligning unit is configured to be pulled out from the sheet processing device so that a sheet jam occurring in the processing tray can be easily fixed.

Such a mechanism is disclosed in, for example, Japanese Patent Application Laid-open No. H10-129920 and Japanese Patent Application Laid-open No. 2006-273493. A sheet post-processing apparatus disclosed in Japanese Patent Application Laid-open No. H10-129920 has been developed to improve an operating efficiency of a stapler included therein. Specifically, the sheet post-processing apparatus includes a sheet-aligning tray member on which sheets are stacked in a state where the sheets are aligned and a stapling unit having the stapler for binding the sheets stacked on the sheet-aligning tray member. The stapling unit housed between a front side plate and a back side plate of the sheet post-processing apparatus is configured to slide ahead of the front side plate. A slidable distance of the stapling unit is configured to be larger than a distance between the front side plate and the back side plate.

Furthermore, a sheet post-processing apparatus disclosed in Japanese Patent Application Laid-open No. 2006-273493 has been developed to improve operating efficiencies of a process for fixing a sheet jam due to a staple of a stapler and a process for supplying staples to the stapler and to perform these processes safely. Specifically, the sheet post-processing apparatus includes a sheet processing tray and a stapler unit having the stapler for stapling sheets in the sheet processing tray. The sheet processing tray and the stapler unit are separately installed on the sheet post-processing apparatus, and can be separately pulled out from the sheet post-processing apparatus. The stapler is capable of sliding in the same direction as that the stapler unit is pulled out from the apparatus along with the stapler unit. A latch member is provided to the stapler unit so that the stapler unit is prevented from being freely pulled in and out from the apparatus thereby interfering with the apparatus. While the stapler is sliding toward outside the apparatus, the latch member is pressed by having contact with the stapler, and thereby moving toward the apparatus. When the latch member is released from the contact with the stapler, the latch member moves back toward the stapler unit.

Moreover, in a conventional technology, as shown in FIG. 42, a processing tray F has functions of aligning and binding sheets with a jogger and an edge binding stapler. However, any conveying member, such as a roller or a guide plate, is not provided to an inlet portion of the processing tray F, i.e., the processing tray F has no function of conveying the sheets. In addition, in this example, a staple discharge roller as a conveying member is provided to a main body of a finisher.

In this manner, according to conventional technologies, a staple discharge roller is provided to a main body of a sheet processing device, and a processing tray (a sheet aligning unit) is configured to be pulled out from the apparatus. Therefore, a positional accuracy may decrease due to a fluctuation in components. Furthermore, to pull out the processing tray from the apparatus, it is necessary to ensure a sufficient space between the apparatus and an adjacent member. As a result, a positional relation between the processing tray and the staple discharge roller becomes unstable. Consequently, an angle of a sheet entering to the processing tray fluctuates as indicated by dashed arrows shown in FIG. 42, and thus it may cause a jam or damage to the sheet.

Furthermore, such a configuration of the sheet processing device has difficulty fixing a sheet jam occurring at a joint portion between the main body of the sheet processing device and the processing tray. If the processing tray is pulled out from the apparatus in a state where a sheet jam occurs at the joint portion, a sheet is damaged because both sides of the sheet are held between sheet conveying rollers. To avoid such a situation, a user has to shift the sheet manually to either the side of the main body of the sheet processing device or the side of the processing tray. However, if no conveying member is provided to the processing tray, it is not possible to shift the sheet.

SUMMARY OF THE INVENTION

It is an object of the present invention to at least partially solve the problems in the conventional technology.

According to an aspect of the present invention, there is provided a sheet processing device including a sheet aligning unit that aligns a sheet recording medium. The sheet aligning unit includes a sheet conveying member for conveying the sheet recording medium, and is configured to be pulled out from a main body of the sheet processing device.

Furthermore, according to another aspect of the present invention, there is provided an image forming apparatus including a sheet processing device including a sheet aligning unit that aligns a sheet recording medium. The sheet aligning unit includes a sheet conveying member for conveying the sheet recording medium, and is configured to be pulled out from a main body of the sheet processing device.

Moreover, according to still another aspect of the present invention, there is provided an image forming system including a sheet processing device including a sheet aligning unit that aligns a sheet recording medium, includes a sheet conveying member for conveying the sheet recording medium, and is configured to be pulled out from a main body of the sheet processing device; an image forming apparatus that forms an image on the sheet recording medium; and a sheet guiding unit that guides the sheet recording medium on which the image is formed by the image forming apparatus to the sheet processing device, and discharges the sheet recording medium to outside.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Exemplary embodiments of the present invention are explained in detail below with reference to the accompanying drawings.

Figure 1:
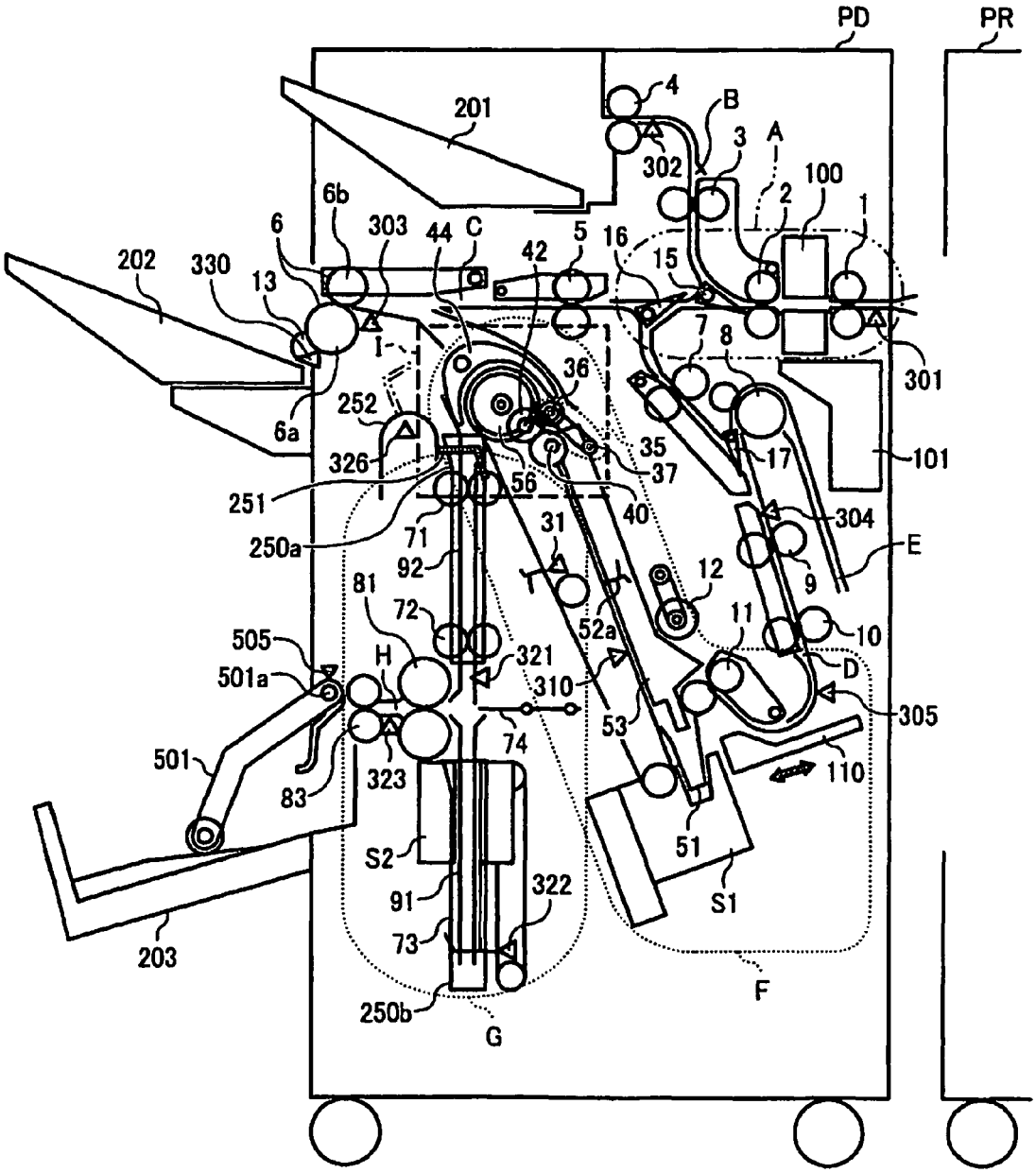
FIG. 1 is a system configuration diagram of a system composed of a sheet post-processing apparatus according to an embodiment of the present invention and an image forming apparatus.

FIG. 1 is a system configuration diagram of a system composed of a sheet post-processing apparatus PD as a sheet processing device according to an embodiment of the present invention and an image forming apparatus PR.

The sheet post-processing apparatus PD is attached to a side surface of the image forming apparatus PR. A sheet discharged from the image forming apparatus PR is guided to the sheet post-processing apparatus PD. The sheet is conveyed through any of conveying paths A, B, C, and D selectively by branch claws 15 and 16. The conveying path A includes a post-processing unit that performs post-processing on sheets one by one (in this embodiment, a punch unit 100 as a punching unit). The conveying path B is used to guide a sheet passing through the conveying path A to an upper tray 201. The conveying path C is used to guide a sheet passing through the conveying path A to a shift tray 202. The conveying path D is used to guide a sheet passing through the conveying path A to a processing tray F where the sheet is, for example, aligned and staple-bound (hereinafter, "an edge-binding processing tray F").

Although the image forming apparatus PR is not fully illustrated in the drawing, the image forming apparatus PR includes at least an image processing circuit, an optical writing device, a developing unit, a transfer unit, and a fixing unit. The image processing circuit converts received image data into printable image data. The optical writing device performs optical writing on a photosensitive element based on an image signal output from the image processing circuit. The developing unit develops a latent image formed on the photosensitive element by the optical writing into a toner image. The transfer unit transfers the toner image onto a sheet. The fixing unit fixes the toner image transferred onto the sheet thereon. The image forming apparatus PR discharges the sheet on which the image is formed to the sheet post-processing apparatus PD. The sheet post-processing apparatus PD performs desired post-processing on the sheet. In the present embodiment, an electrophotographic image forming apparatus is employed as the image forming apparatus PR. Alternatively, any other types of commonly-used image forming apparatuses, such as an ink-jet image forming apparatus or a thermal-transfer type image forming apparatus, can be used as the image forming apparatus PR. Incidentally, in the present embodiment, an image forming unit is composed of the image processing circuit, the optical writing device, the developing unit, the transfer unit, and the fixing unit.

When the sheet is conveyed to the edge-binding processing tray F through the conveying paths A and D, the sheet is, for example, aligned and stapled in the edge-binding processing tray F. After that, the sheet is guided by a guide member 44 so as to be conveyed to any of the conveying path C or a saddle-stitch/center-folding processing tray G (hereinafter, just "a saddle-stitch processing tray G") where the sheet is, for example, folded. After the sheet is folded in the saddle-stitch processing tray G, the sheet is guided to a lower tray 203 through a conveying path H. A branch claw 17 is provided on the conveying path D. The branch claw 17 is maintained in a state shown in FIG. 1 by a low-load spring (not shown). After the sheet is conveyed by a pair of conveying rollers 7 and a trailing end of the sheet passes by the branch claw 17, out of pairs of conveying rollers 9 and 10 and a pair of staple discharge rollers 11, at least the conveying rollers 9 are rotated in a reverse direction, so that the sheet is conveyed backward along a turn guide 8. As a result, the sheet is guided to a sheet containing unit E to enter thereto from the trailing end of the sheet, and retained (pre-stacked) on the sheet containing unit E. A subsequently-conveyed sheet is stacked on top of the sheet in a superimposed manner so as to be conveyed all together. By the repetition of this operation, it is possible to convey more than two sheets all together. Incidentally, a reference numeral 304 denotes a pre-stack sensor used for setting a timing for conveying a sheet backward to be pre-stacked on the sheet containing unit E.

The conveying path A is located on the upstream of the conveying paths B, C, and D, and is a common pathway connecting to each of the conveying paths-B, C, and D. Along the conveying path A, an inlet sensor 301, a pair of inlet rollers 1, the punch unit 100, a chad hopper 101, a pair of conveying rollers 2, the branch claws 15 and 16 are arranged in this order from an inlet. The branch claws 15 and 16 are maintained in a state shown in FIG. 1 by a spring (not shown). When each of solenoids (not shown) for driving the branch claws 15 and 16 respectively is turned on, the solenoid drives the corresponding branch claw to rotate so as to guide the sheet to any of the conveying paths B, C, and D.

When the sheet is to be guided to the conveying path B, the solenoids are turned off, i.e., the branch claws 15 and 16 are in the state shown in FIG. 1. When the sheet is to be guided to the conveying path C in the state shown in FIG. 1, the solenoids are turned on, whereby the branch claw 15 is driven to rotate upward and the branch claw 16 is driven to rotate downward. As a result, the sheet is discharged onto the upper tray 201 by passing through between a pair of conveying rollers 3 and a pair of discharge rollers 4. When the sheet is to be guided to the conveying path D in the state shown in FIG. 1, i.e., both the solenoids are turned off, the solenoid for the branch claw 15 is turned on when the branch claw 15 is in the state shown in FIG. 1, whereby the branch claw 15 is driven to rotate upward. As a result, the sheet is conveyed toward the shift tray 202 by passing through between a pair of conveying rollers 5 and a pair of shift discharge rollers 6 (6*a* and 6*b*).

The sheet post-processing apparatus PD can perform punching (by the punch unit 100), sheet alignment and edge binding (by a jogger fence 53 and an edge binding stapler S1), sheet alignment and saddle-stitch binding (by a saddle-stitch upper jogger fence 250*a*, a saddle-stitch lower jogger fence 250*b*, and a saddle-stitch binding stapler S2), sheet sorting (by the shift tray 202), center-folding (by a folding plate 74 and a pair of folding rollers 81), and the like.

As shown in FIG. 1, a shift-tray unit located on the most downstream of the sheet post-processing apparatus PD includes the shift discharge rollers 6 (6*a* and 6*b*), a return roller 13, a sheet-face detecting sensor 330, the shift tray 202, a shift mechanism, and a shift-tray lifting mechanism. The shift mechanism causes the shift tray 202 to move in a reciprocating manner in a direction perpendicular to a sheet conveying direction (see FIG. 2). The shift-tray lifting mechanism lifts the shift tray 202 up and down.

The return roller 13 is made of sponge. The return roller 13 serves to align a sheet discharged from the shift discharge rollers 6 in such a manner that the return roller 13 has contact with the sheet and strikes a trailing end of the sheet on an end fence 32 (see FIG. 2). The return roller 13 rotates in accordance with rotation of the shift discharge rollers 6. As shown in FIG. 3, a tray lift-up limiting switch 333 is provided near the return roller 13. When the shift tray 202 is lifted up, the return roller 13 is pressed up, so that the tray lift-up limiting switch 333 is turned on, and a tray lifting motor is stopped. Therefore, it is possible to prevent the shift tray 202 from overrunning. Furthermore, as shown in FIG. 1, the sheet-face detecting sensor 330 is arranged near the return roller 13. The sheet-face detecting sensor 330 detects a position of a sheet face of a sheet or a stack of sheets to be discharged onto the shift tray 202.

In the present embodiment, as shown in FIG. 3, a sheet-face detecting sensor (for stapling) 330*a* and a sheet-face detecting sensor (for non-stapling) 330*b* are used as the sheet-face detecting sensor 330. The sheet-face detecting sensor (for stapling) 330*a* and the sheet-face detecting sensor (for non-stapling) 330*b* are configured to be turned on when the sheet-face detecting sensor (for stapling) 330*a* and the sheet-face detecting sensor (for non-stapling) 330*b* are shielded by a shielding member 30*b*. Therefore, when a contact portion 30*a* of a sheet-face detecting lever 30 rotates upward due to the lift-up of the shift tray 202, the sheet-face detecting sensor (for stapling) 330*a* is turned off. When the contact portion 30*a* of the sheet-face detecting lever 30 further rotates upward, the sheet-face detecting sensor (for non-stapling) 330*b* is turned on. When the sheet-face detecting sensor (for stapling) 330*a* and the sheet-face detecting sensor (for non-stapling) 330*b* detect that a height of stacked sheets reaches a predetermined height, the shift tray 202 is lifted down for a predetermined distance by a drive force of a tray lifting motor 168. Therefore, a position of a sheet face of sheet(s) discharged onto the shift tray 202 is maintained substantially constant.

The shift tray 202 is lifted up and down when a drive shaft 21 of which is driven by a drive unit (not shown). A timing belt 23 is looped over the drive shaft 21 and a driven shaft 22 via a timing pulley (not shown) with a tension. Both ends of a side plate 24 for supporting the shift tray 202 are fixed to the timing belts 23, so that the shift-tray unit including the shift tray 202 can be lifted up and down.

A drive source for driving the shift tray 202 to move up and down is the tray lifting motor 168. The tray lifting motor 168 can rotate in any of forward and reverse directions. A power generated by the tray lifting motor 168 is transmitted to a last gear of a gear train that is fixed to the driveshaft 21 via a worm gear 25. The power transmission is through the worm gear 25, so that the shift tray 202 can be maintained in a predetermined position constantly, and also the shift tray 202 can be prevented from falling down abruptly.

A shielding plate 24*a* is integrally formed on the side plate 24. A sheet-laden detecting sensor 334 and a lower-limit-position sensor 335 are arranged below the shielding plate 24*a*. The sheet-laden detecting sensor 334 detects whether the shift tray 202 is laden with stacked sheets up to full capacity. The lower-limit-position sensor 335 detects a lower limit position of the shift tray 202. The sheet-laden detecting sensor 334 and the lower-limit-position sensor 335 are turned on/off by the shielding plate 24*a*. Specifically, as the sheet-laden detecting sensor 334 and the lower-limit-position sensor 335, a photosensor is employed in the present embodiment. When shielded by the shielding plate 24*a*, each of the sheet-laden detecting sensor 334 and the lower-limit-position sensor 335 is turned on. Incidentally, the shift discharge rollers 6 are omitted from FIG. 3 for simplicity.

Figure 2:
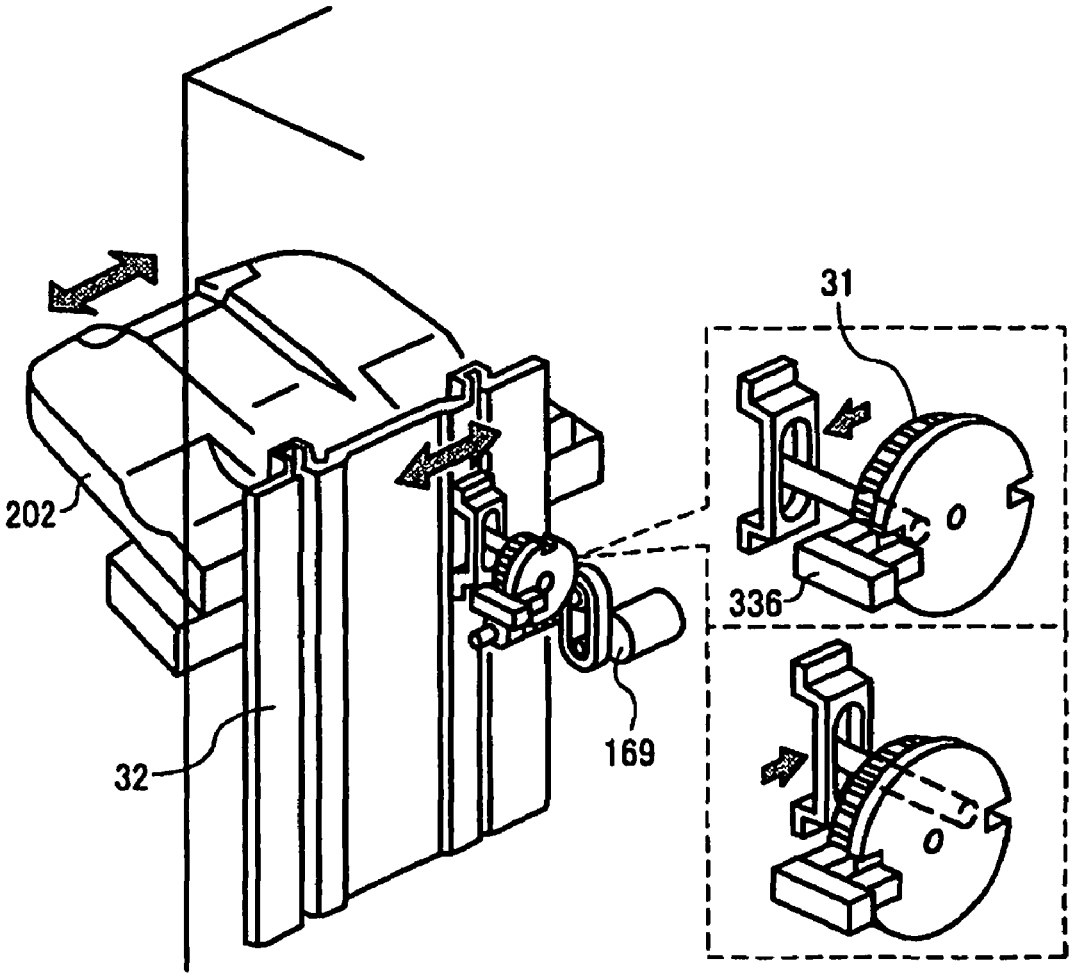
FIG. 2 is a perspective view of a shift mechanism of the sheet post-processing apparatus shown in FIG. 1.
Figure 3:
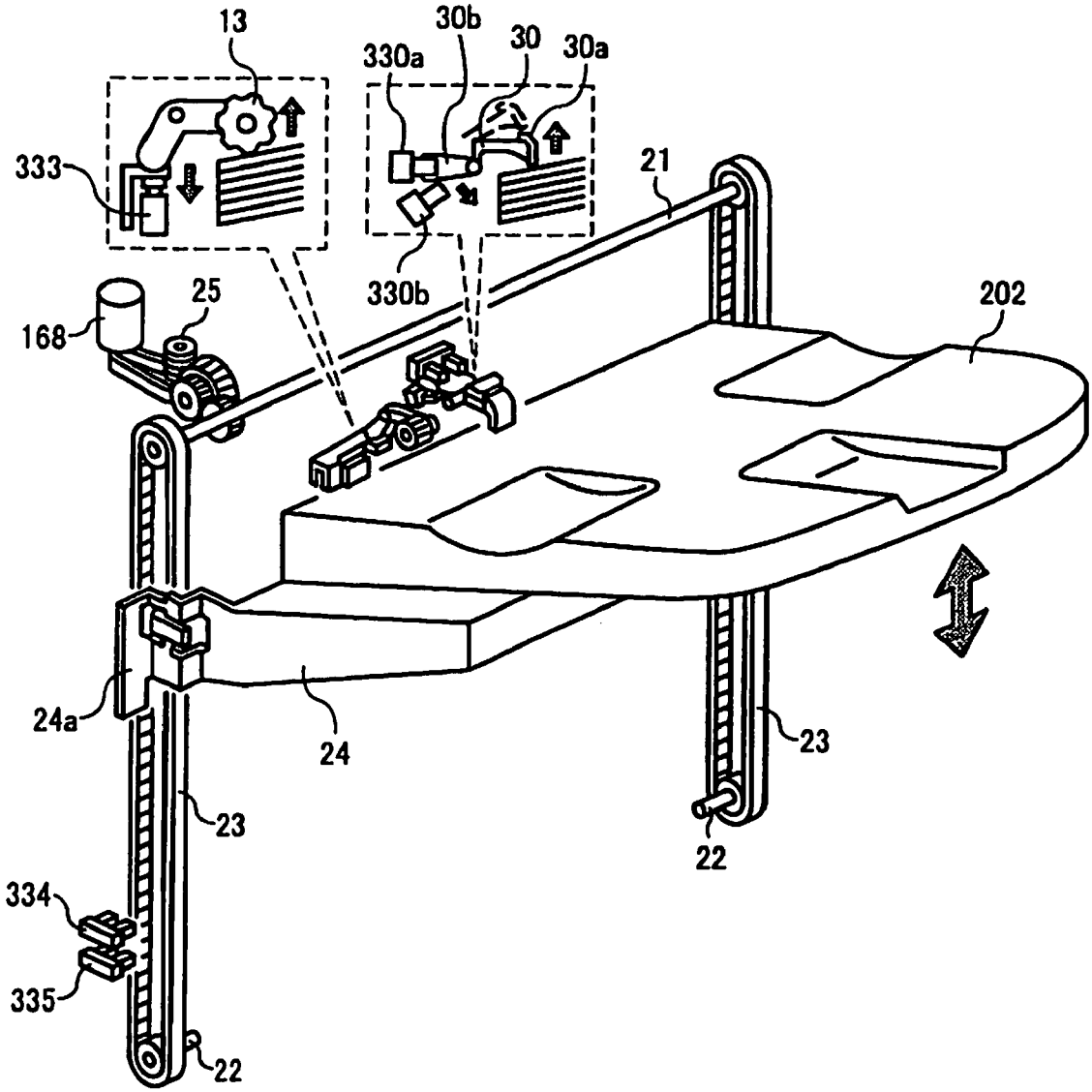
FIG. 3 is a perspective view of a lifting mechanism for a shift tray of the sheet post-processing apparatus shown in FIG. 1.

As shown in FIG. 2, an oscillating mechanism of the shift tray 202 includes a shift motor 169 as a drive source. A shift cam 31 rotates by a drive force from the shift motor 169. A pin is driven straight into the shift cam 31 at a position away from a rotating central axis of which with keeping a predetermined distance. The pin serves to guide a trailing end of a sheet stacked on the shift tray 202. A free end of the pin is freely fitted into a long hole formed on the end fence 32 in a direction perpendicular to a sheet discharging direction. Therefore, the end fence 32 moves in the direction perpendicular to the sheet discharging direction in accordance with rotation of the shift cam 31, and the shift tray 202 also moves along with the movement of the end fence 32. The shift tray 202 stops moving at either a front position or a back position. The stop position of the shift tray 202 is detected by a shift sensor 336. Depending on a result of the detection by the shift sensor 336, the shift motor 169 is turned on or off so as to control the movement of the shift tray 202 in the direction perpendicular to the sheet discharging direction.

Figure 4:
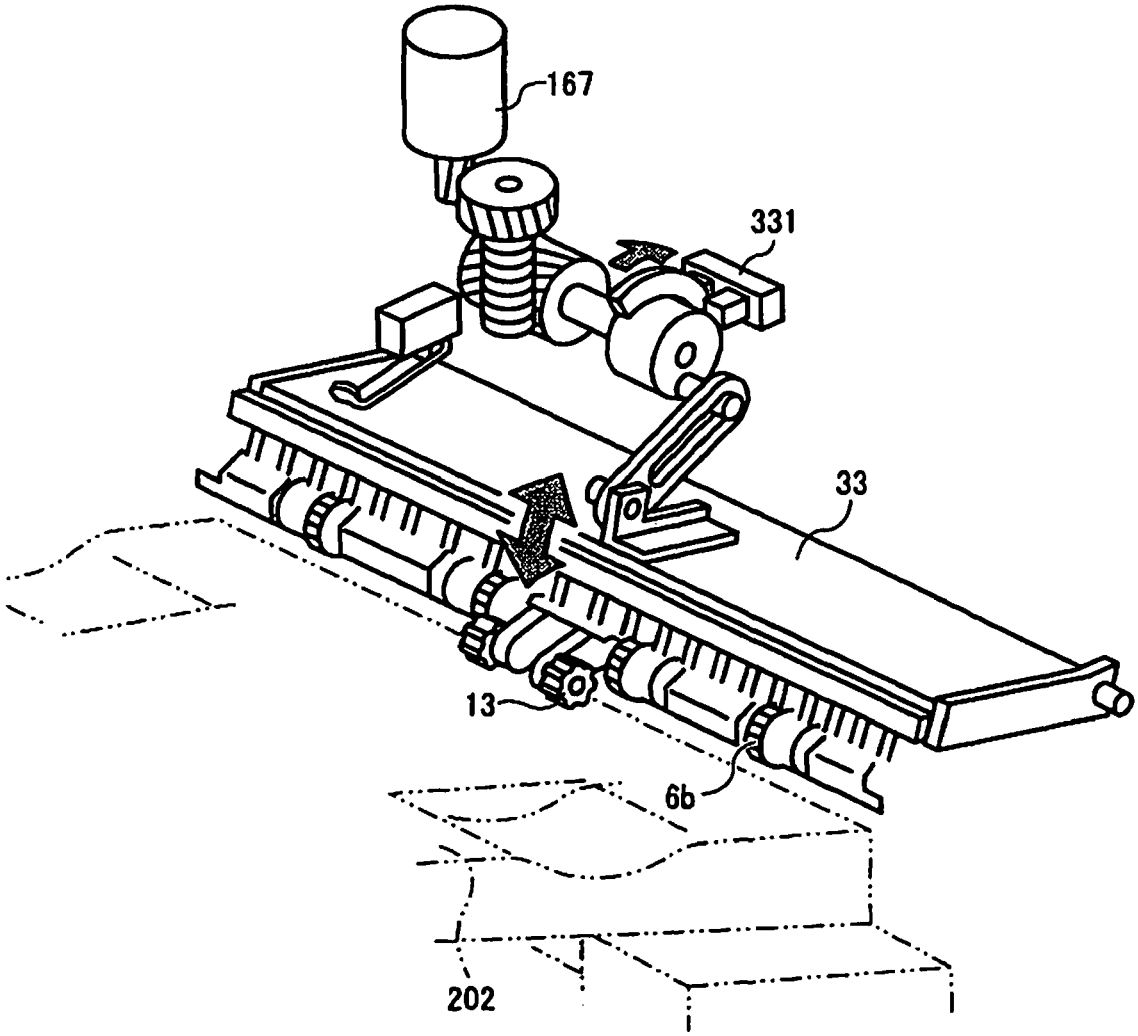
FIG. 4 is a perspective view of a mechanism for shift discharge rollers and an openable guide plate of the sheet post-processing apparatus shown in FIG. 1.

As shown in FIGS. 1 and 4, the shift discharge rollers 6 are composed of the shift discharge drive roller 6*a* and the shift discharge driven roller 6*b*. The shift discharge driven roller 6*b* is rotatably supported by a free end of an openable guide plate 33. One end of the openable guide plate 33 on the upstream side in the sheet discharging direction is supported, and the other end can rotate up and down. The shift discharge driven roller 6*b* has contact with the shift discharge drive roller 6*a* by the use of its own weight or a bias force, so that the sheet is discharged while being sandwiched between the shift discharge drive roller 6*a* and the shift discharge driven roller 6*b*. When a stack of sheets processed to be bound is discharged, the openable guide plate 33 rotates upward, and then rotates back at a predetermined timing. The predetermined timing is determined based on a detection signal from a discharge sensor 303. A stop position of the openable guide plate 33 is determined based on a detection signal from a discharge guide-plate open/close sensor 331. The openable guide plate 33 is driven to rotate by a discharge guide-plate open/close motor 167.

A configuration of the edge-binding processing tray F in which sheets are stapled is explained below with reference to FIGS. 5, 6, 12, and 13.

A sheet guided to the edge-binding processing tray F by the staple discharge rollers 11 is sequentially stacked on top of previously-stacked sheets on the edge-binding processing tray F. In this case, each time a sheet is stacked on top of the other on the edge-binding processing tray F, the stacked sheets are aligned in a longitudinal direction (the sheet conveying direction) by a return roller 12, and then aligned in a lateral direction (a direction perpendicular to the sheet conveying direction, i.e., a sheet width direction) by the jogger fence 53. At an interval between jobs, i.e., an interval between when a last sheet of a stack of sheets is conveyed and when a first sheet of a subsequent stack of sheets is conveyed, the edge binding stapler S1 is activated by a stapling signal from a control unit 350 (see FIG. 33), and a stack of sheets is bound by the edge binding stapler S1. After that, the stack of sheets is promptly conveyed to the shift discharge rollers 6 by a discharge belt 52 on which a discharge claw 52*a* is provided to project therefrom, and discharged onto the shift tray 202 set up at a pick-up position.

Figure 12:
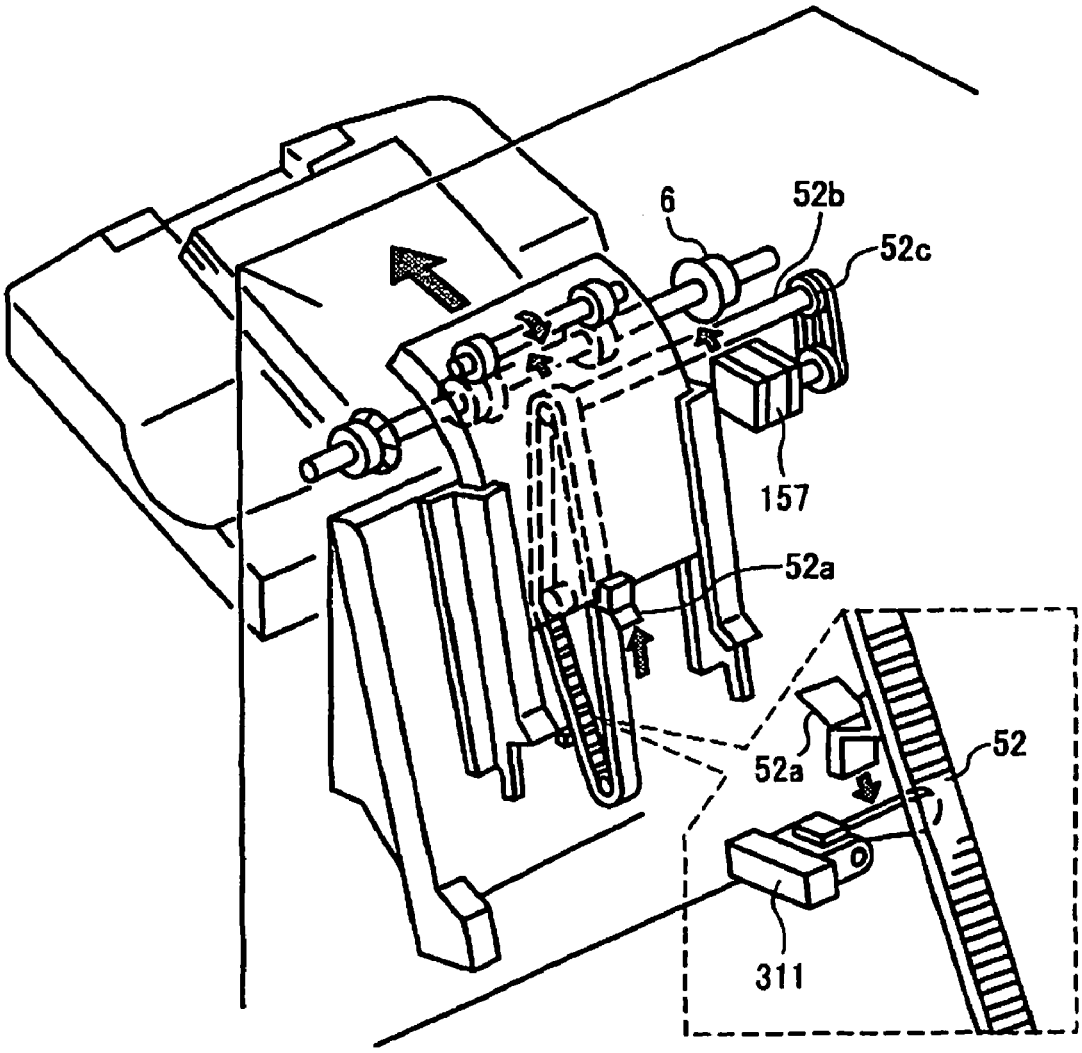
FIG. 12 is a perspective view of a drive mechanism of a discharge belt and a discharge claw those for pressing up a stack of sheets.

As shown in FIG. 12, a home position of the discharge claw 52*a* is detected by a discharge-belt HP sensor 311. The discharge-belt HP sensor 311 is turned on/off by the discharge claw 52*a*. Actually, two numbers of the discharge claws 52*a* are provided on an outer circumference of the discharge belt 52 to be opposed to each other. The discharge claws 52*a* alternately convey a stack of sheets contained in the edge-binding processing tray F. Furthermore, the discharge belt 52 can be rotated in an inverse direction as needed, whereby a leading end of a stack of sheets contained in the edge-binding processing tray F in the conveying direction can be aligned by back surfaces of the discharge claws 52*a* that stand by for conveying a subsequent stack of sheets. Therefore, the discharge claws 52*a* also serve as an aligning unit for aligning a stack of sheets in the sheet conveying direction.

Figure 5:
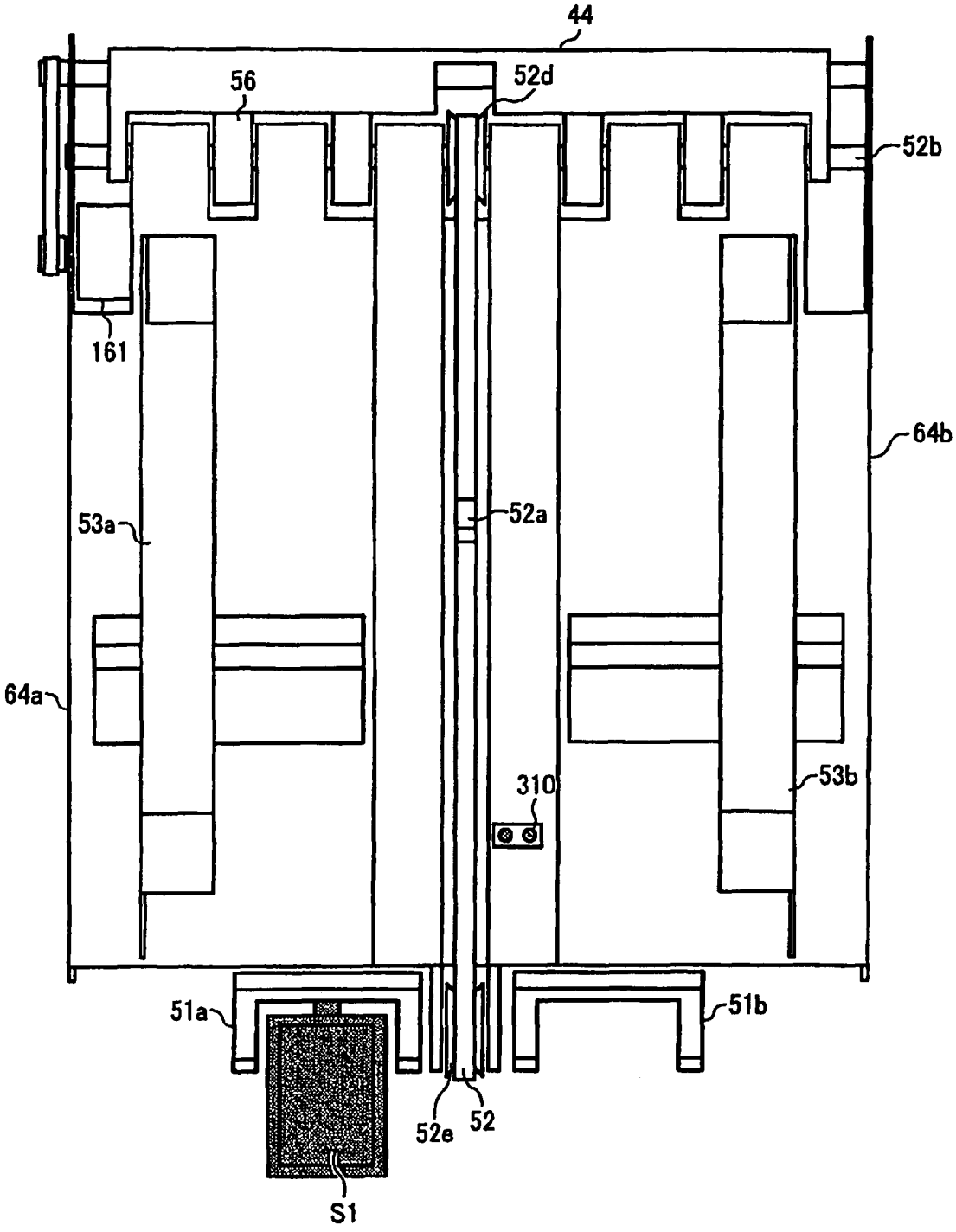
FIG. 5 is a plan view showing a configuration of an edge-binding processing tray on which a stapling process is performed.

Moreover, as shown in FIG. 5, the discharge belt 52 is located at the alignment center in the sheet width direction. The discharge belt 52 is supported by a drive pulley 52*d* and a driven pulley 52*e*, and driven to rotate by a discharge motor 157 via a drive shaft 52*b* and a pulley 52*c* (see FIG. 12). A plurality of discharge rollers 56 are symmetrically arranged across the discharge belt 52. The discharge rollers 56 are rotatably supported by the drive shaft 52*b* thereby serving as driven rollers. Incidentally, reference numerals 64*a* and 64*b* respectively denote a front side plate and a back side plate, reference numerals 51*a* and 51*b* respectively denote a front-side trailing-end fence and a back-side trailing-end fence (indicated by a reference numeral 51 in FIG. 1), and reference numerals 53*a* and 53*b* respectively denote a front-side jogger fence and a back-side jogger fence.

Figure 6:
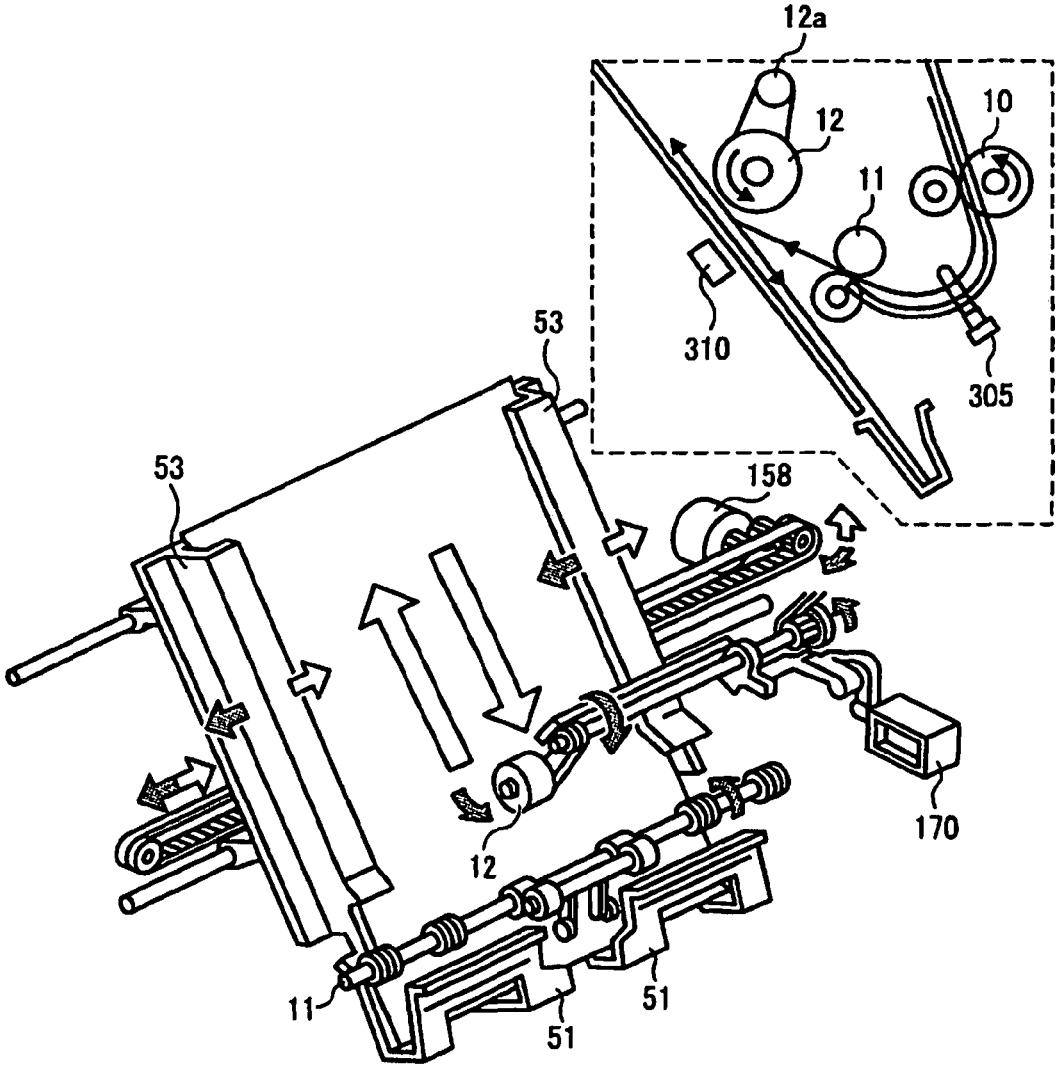
FIG. 6 is a perspective view of the edge-binding processing tray.

As shown in FIG. 6, the return roller 12 is caused to swing like a pendulum around a supporting point 12*a* by a tap solenoid 170, whereby a trailing end of a sheet conveyed to the edge-binding processing tray F is struck on the jogger fence 53 intermittently. Incidentally, the return roller 12 rotates counterclockwise. As shown in FIG. 5, the jogger fence 53 includes the front-side jogger fence 53*a* and the back-side jogger fence 53*b*. The front-side jogger fence 53*a* and the back-side jogger fence 53*b* are driven to move in a reciprocating manner in the sheet width direction by a jogger motor 158 via a timing belt. The jogger motor 158 can rotate in any of forward and reverse directions.

Figure 13:
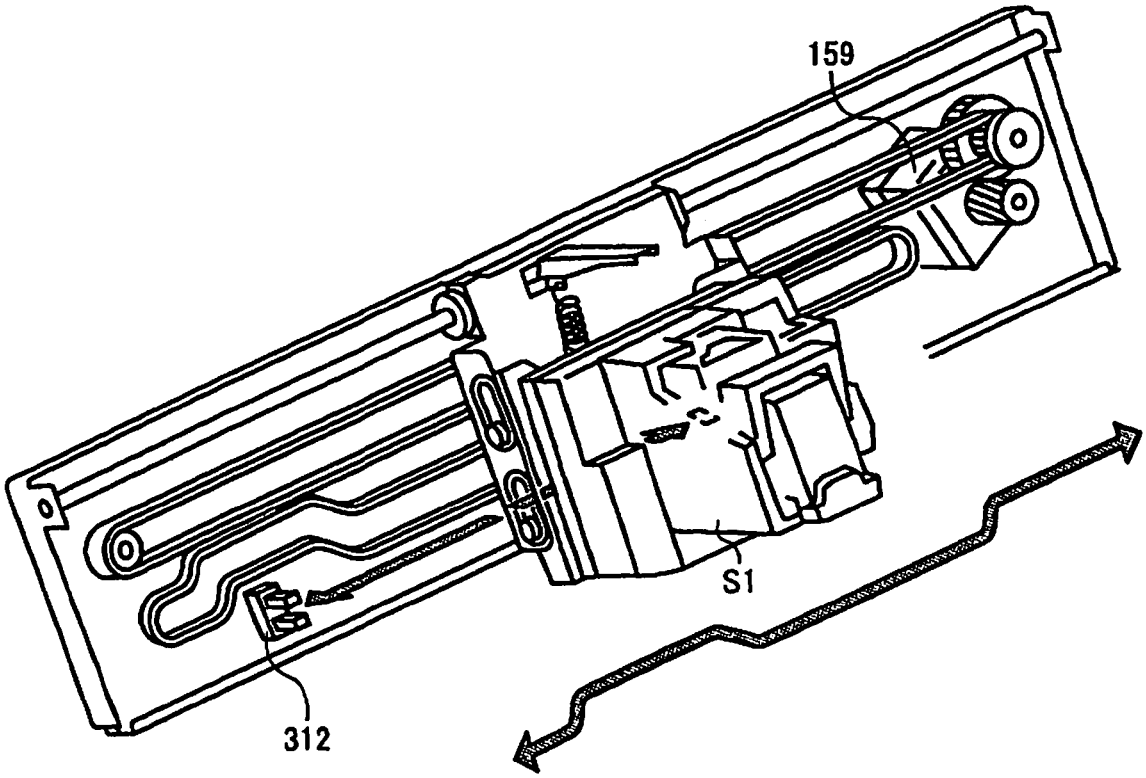
FIG. 13 is a perspective view showing a configuration of an edge binding stapler.

As shown in FIG. 13, the edge binding stapler S1 is driven to move in the sheet width direction by a stapler travel motor 159 via a timing belt so that the edge binding stapler S1 can bind an edge portion of sheets at a predetermined position. The stapler travel motor 159 can rotate in any of forward and reverse directions. A stapler travel HP sensor 312 is provided on the side of one end of a travel range of the edge binding stapler S1. The stapler travel HP sensor 312 detects a home position of the edge binding stapler S1. A binding position of sheets in the sheet width direction is controlled by controlling a travel distance of the edge binding stapler S1 from the home position.

Figure 14:
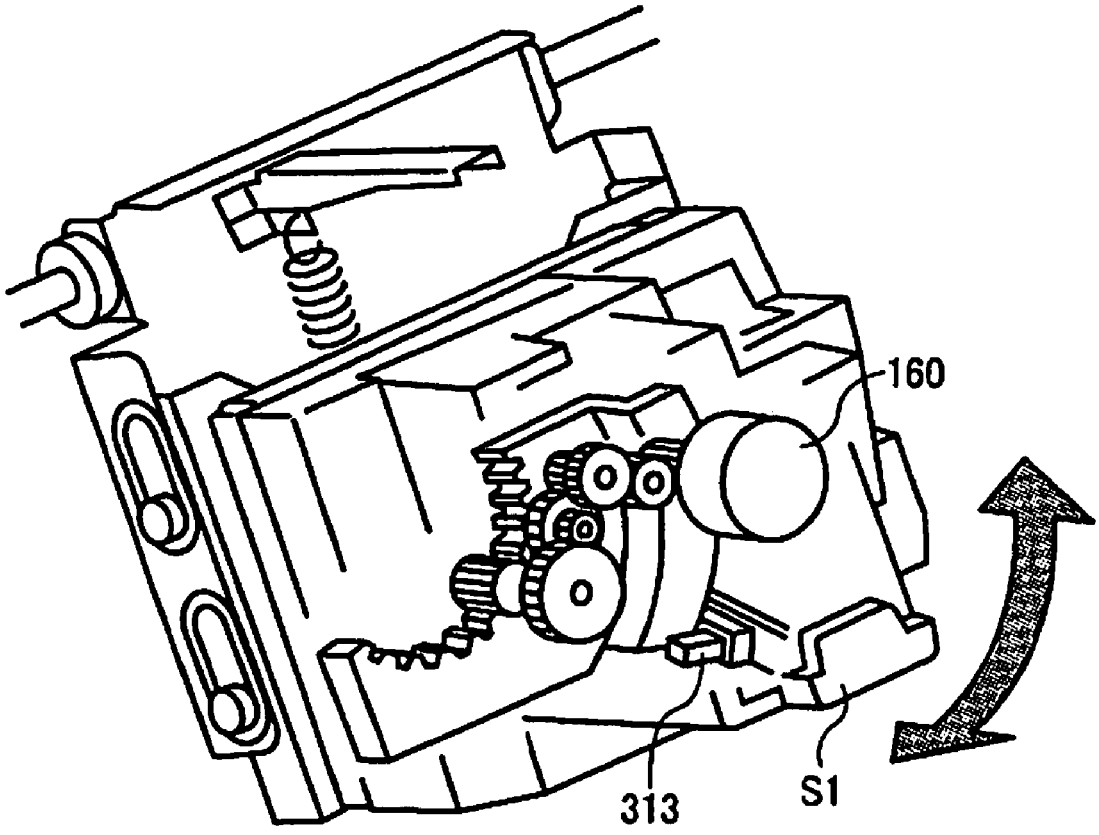
FIG. 14 is a perspective view for explaining an oblique binding mechanism of the edge binding stapler.

FIG. 14 is a perspective view for explaining an oblique binding mechanism of the edge binding stapler S1.

The edge binding stapler S1 is configured to be able to change a stapling angle of which to be either parallel or oblique to an edge portion of sheets. Furthermore, the edge binding stapler S1 is configured that only a binding mechanism portion of which can be obliquely-rotated at a predetermined angle when the edge binding stapler S1 is located at the home position, so that a user can easily supply staples to the edge binding stapler S1. Specifically, the edge binding stapler S1 is obliquely-rotated at the predetermined angle by an oblique motor 160. When a staple-supplying-position detecting sensor detects that the edge binding stapler S1 is rotated at the predetermined angle or the edge binding stapler S1 is located at a staple supplying position, the oblique motor 160 stops rotating. Upon completion of oblique-stapling or supply of staples, the edge binding stapler S1 rotates back to the home position so as to stand by for a subsequent stapling process. Incidentally, a reference numeral 310 shown in FIGS. 1 and 5 denotes a sheet detecting sensor that detects whether there is any sheet in the edge-binding processing tray F.

Subsequently, a mechanism for pressing an uplift of a trailing end portion of a stack of sheets is explained below with reference to FIGS. 7 to 11. The mechanism presses a trailing end portion of a stack of sheets stacked on the edge-binding processing tray F to prevent an uplift behavior of the trailing end portion.

Figure 7:
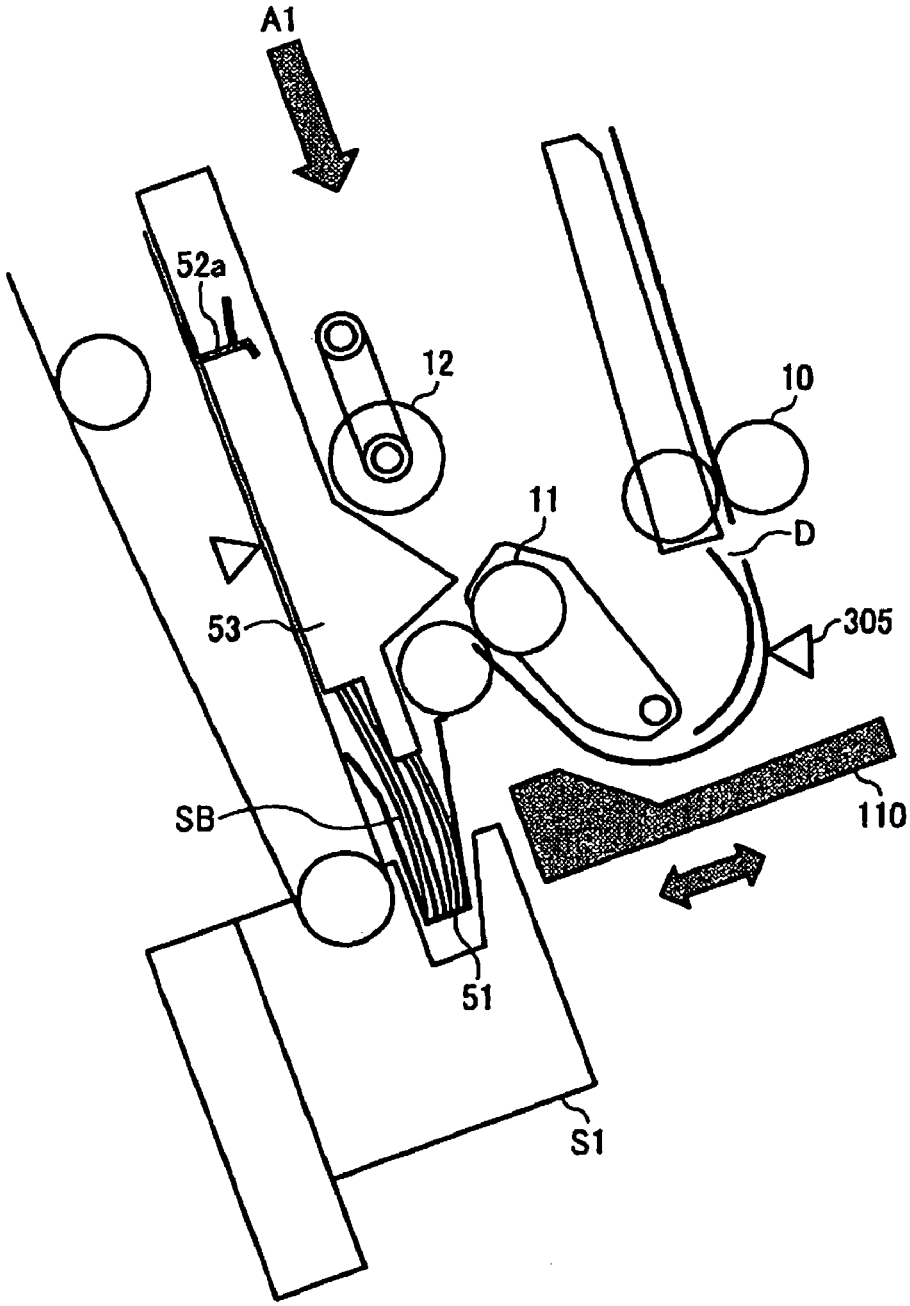
FIG. 7 is a schematic diagram of a mechanism for pressing an uplift of a trailing end portion of a stack of sheets stacked on the edge-binding processing tray.

The sheets discharged onto the edge-binding processing tray F are aligned in the longitudinal direction (the sheet conveying direction) by the return roller 12, as described above. At this time, a trailing end of any of the sheets may be curled up, or if the sheets are soft, a trailing end of each of the sheets tends to buckle by its own weight. Furthermore, as the number of stacked sheets increases, a space of the trailing-end fence 51 for a subsequently-stacked sheet is getting decreased. Therefore, it becomes difficult to align sheets in the longitudinal direction gradually. To solve the problems, the mechanism is provided to prevent an uplift behavior of a trailing end portion of the sheets and thereby making it easy for a subsequently-stacked sheet to be put into the trailing-end fence 51. FIG. 7 is a front view of the mechanism. The trailing-end fence 51 presses a trailing end portion of a stack of sheets SB contained therein. A trailing-end-portion pressing lever 110 is arranged near a bottom portion of the trailing-end fence 51, and moves in a reciprocating manner in a direction nearly perpendicular to the edge-binding processing tray F.

Figure 8:
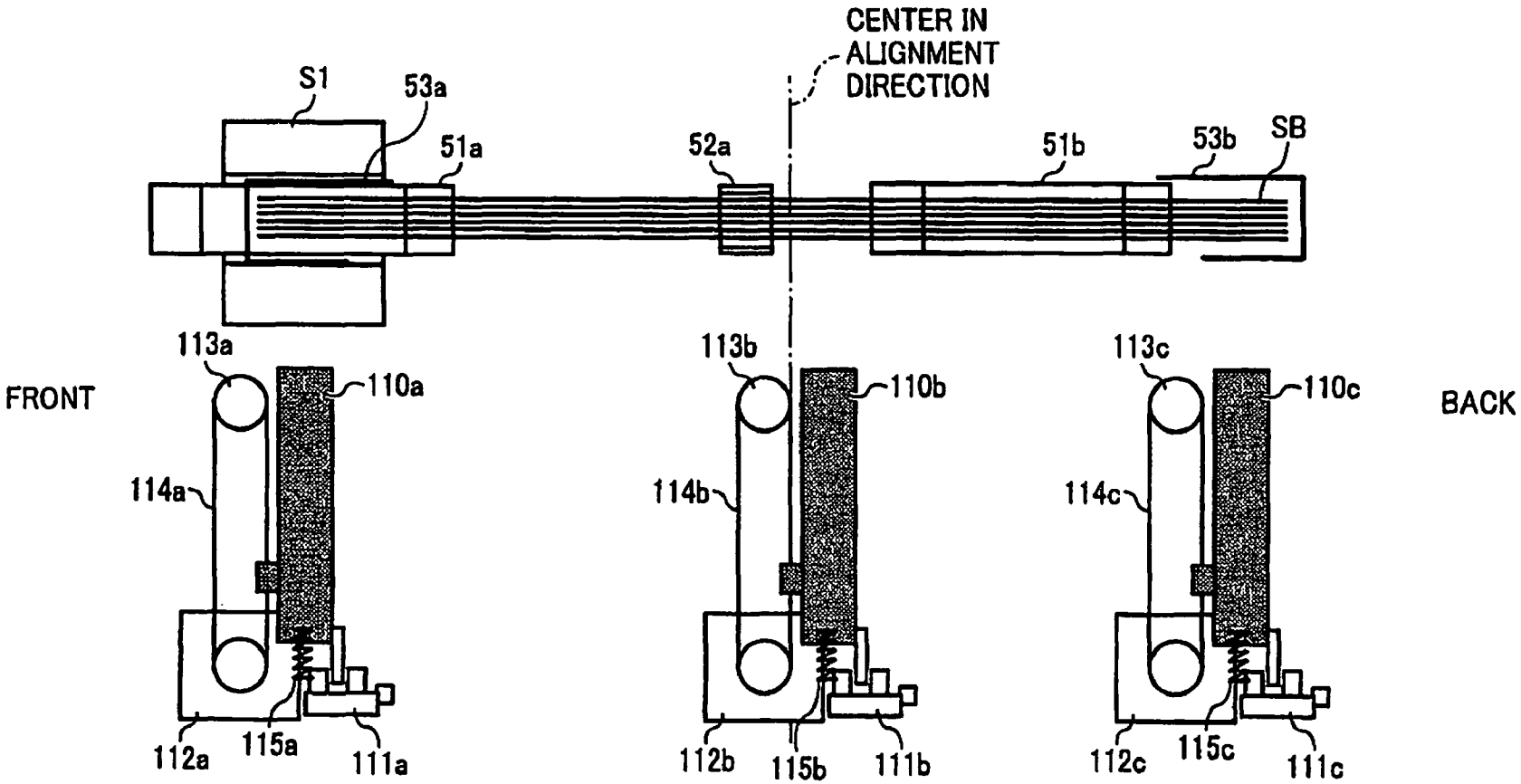
FIG. 8 is a schematic diagram of the mechanism viewed from a direction of an arrow A1 shown in FIG. 7.

As shown in FIG. 8, the trailing-end-portion pressing lever 110 includes three trailing-end-portion pressing levers 110*a*, 110*b*, and 110*c* that are respectively arranged in the front side, the center, and the back side of the apparatus. A mechanism of the trailing-end-portion pressing lever 110*a* located in the front side of the apparatus is explained below. The trailing-end-portion pressing lever 110*a* is fixed to a timing belt 114*a*. The timing belt 114*a* is connected to a trailing-end-portion pressing motor 112*a* via a pulley 113*a*, so that the timing belt 114 moves in accordance with rotation of the trailing-end-portion pressing motor 112*a*. When a home sensor 111*a* is shielded by a convex shielding portion formed on the trailing-end-portion pressing lever 110*a*, the home sensor 111*a* detects a home position of the trailing-end-portion pressing lever 110*a*. The home position of the trailing-end-portion pressing lever 110*a* is set up at a position where the trailing-end-portion pressing lever 110*a* does not interfere with the edge binding stapler S1 even when the edge binding stapler S1 moves in a direction of an arrow shown in FIG. 13 (the sheet width direction) to bind an edge portion of sheets. A travel distance of the trailing-end-portion pressing lever 110*a* in a direction of pressing a trailing end portion of a stack of sheets, i.e., a direction of an arrow shown in FIG. 7 is determined depending on the number of pulses input to the trailing-end-portion pressing motor 112*a*. The trailing-end-portion pressing lever 110*a* moves to a position where a tip of the trailing-end-portion pressing lever 110*a* presses an uplift of the trailing end portion of the stack of sheets while being in contact with the stack of sheets SB. A change in a thickness of the stack of sheets SB is absorbed by a stretching movement of a spring 115*a*. The trailing-end-portion pressing levers 110*b* and 110*c* have the same mechanism as the trailing-end-portion pressing lever 110*a*, so that description is omitted.

Figure 9:
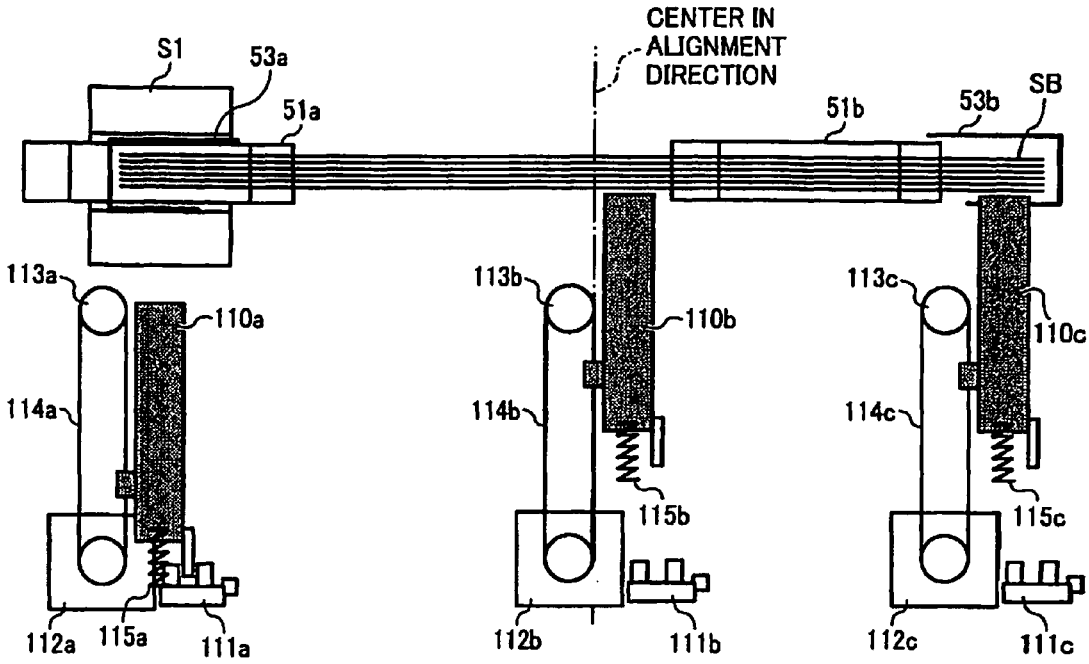
FIG. 9 is a schematic diagram of the mechanism shown in FIG. 8 for explaining a positional relation between a trailing-end pressing lever and a stand-by position of a stapler in a front-side binding mode.
Figure 10:
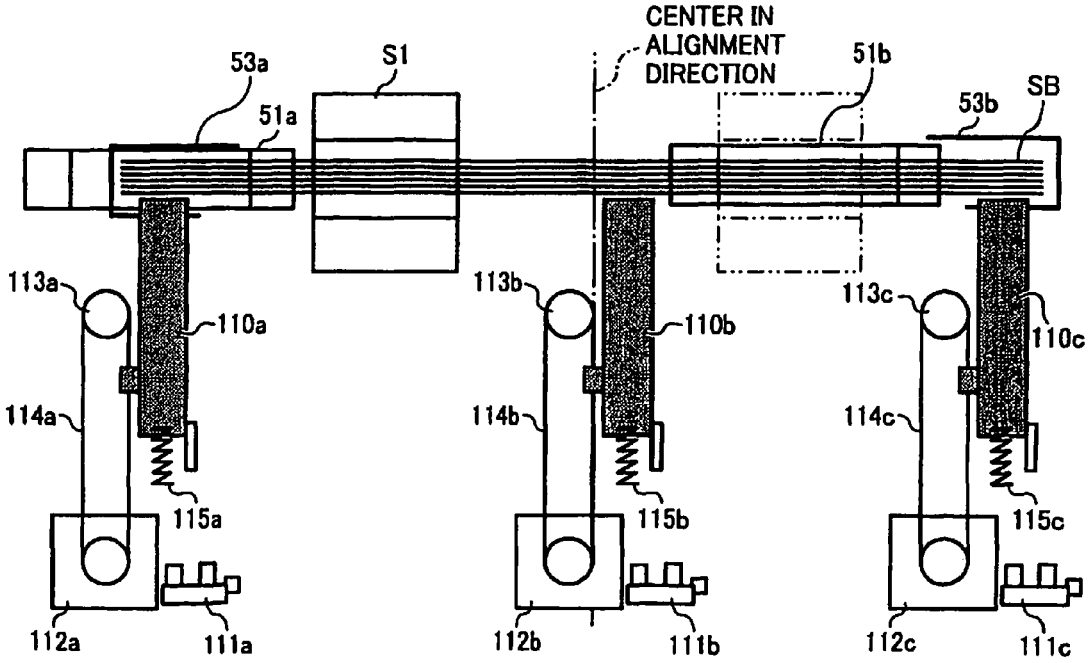
FIG. 10 is a schematic diagram of the mechanism shown in FIG. 8 for explaining a positional relation between the trailing-end pressing lever and a stand-by position of the stapler in a two-point binding mode.
Figure 11:
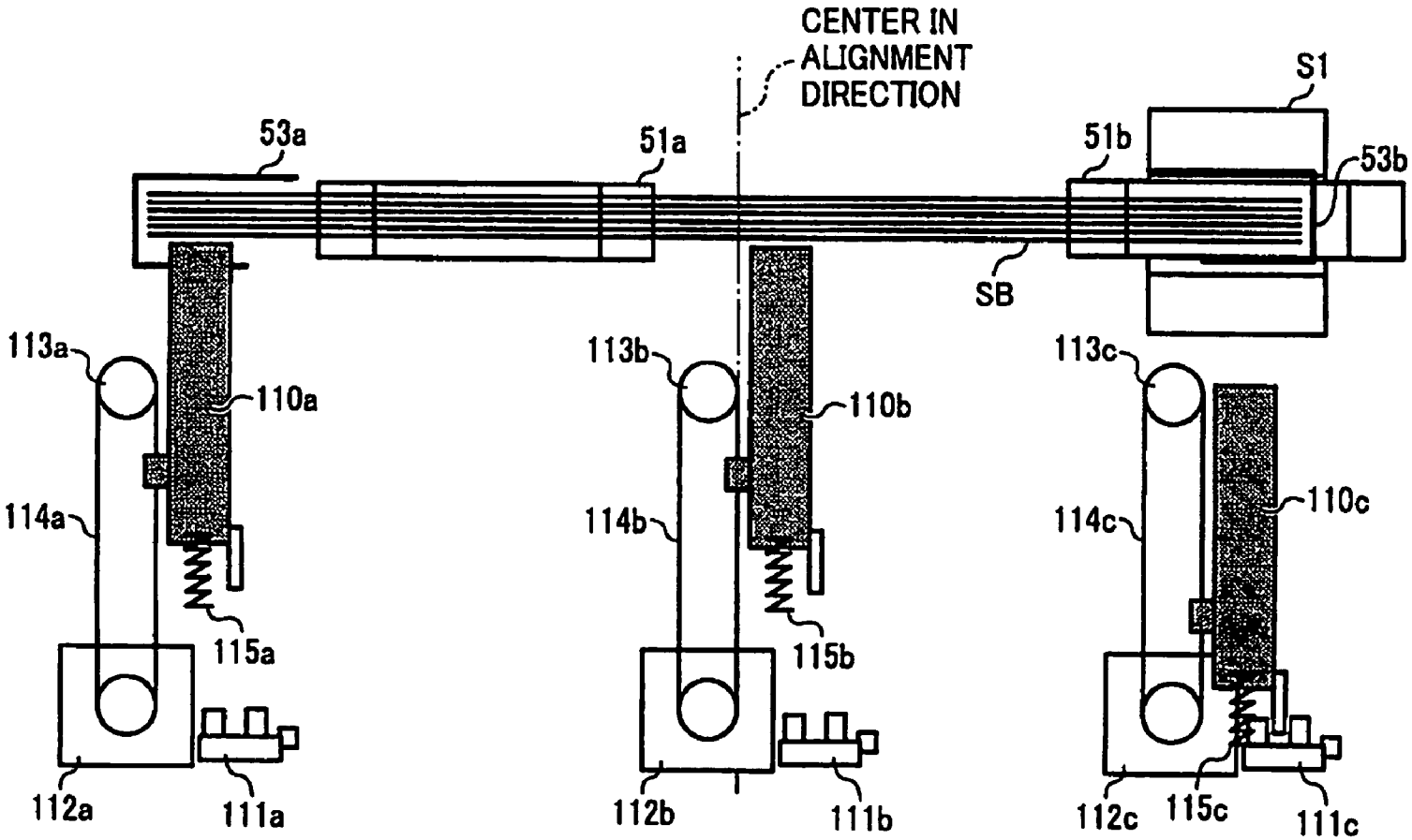
FIG. 11 is a schematic diagram of the mechanism shown in FIG. 8 for explaining a positional relation between the trailing-end pressing lever and a stand-by position of the stapler in a back-side binding mode.

FIGS. 9, 10, and 11 show a positional relation between the trailing-end-portion pressing levers 110*a*, 110*b*, and 110*c* and a stand-by position of the edge binding stapler S1 in each of binding modes. The stand-by position of the edge binding stapler S1 differs in each of the binding modes. A position of the edge binding stapler S1 shown in FIG. 9 is the stand-by position of the edge binding stapler S1 in a front-side edge binding mode. A position of the edge binding stapler S1 shown in FIG. 10 is the stand-by position of the edge binding stapler S1 in a two-point binding mode. A position of the edge binding stapler S1 shown in FIG. 11 is the stand-by position of the edge binding stapler S1 in a back-side edge binding mode. When the edge binding stapler S1 is located at each of the stand-by positions, if any of the trailing-end-portion pressing levers 110*a*, 110*b*, and 110*c* is activated, the trailing-end-portion pressing lever needs to prevent an interference with the edge binding stapler S1. In the front-side edge binding mode, as shown in FIG. 9, the trailing-end-portion pressing levers 110*b* and 110*c* are activated. In the two-point binding mode, as shown in FIG. 10, the trailing-end-portion pressing levers 110*a*, 110*b*, and 110*c* are activated. In the back-side edge binding mode, as shown in FIG. 11, the trailing-end-portion pressing levers 110*a* and 110*b* are activated. An activation timing of each of the trailing-end-portion pressing levers 110*a*, 110*b*, and 110*c* in each of the binding modes is set up to within a time from when a discharged sheet is stacked on the other in the trailing-end fence 51 and aligned in the sheet width direction by the jogger fence 53 to when a subsequent sheet is aligned by the return roller 12.

Figure 15:
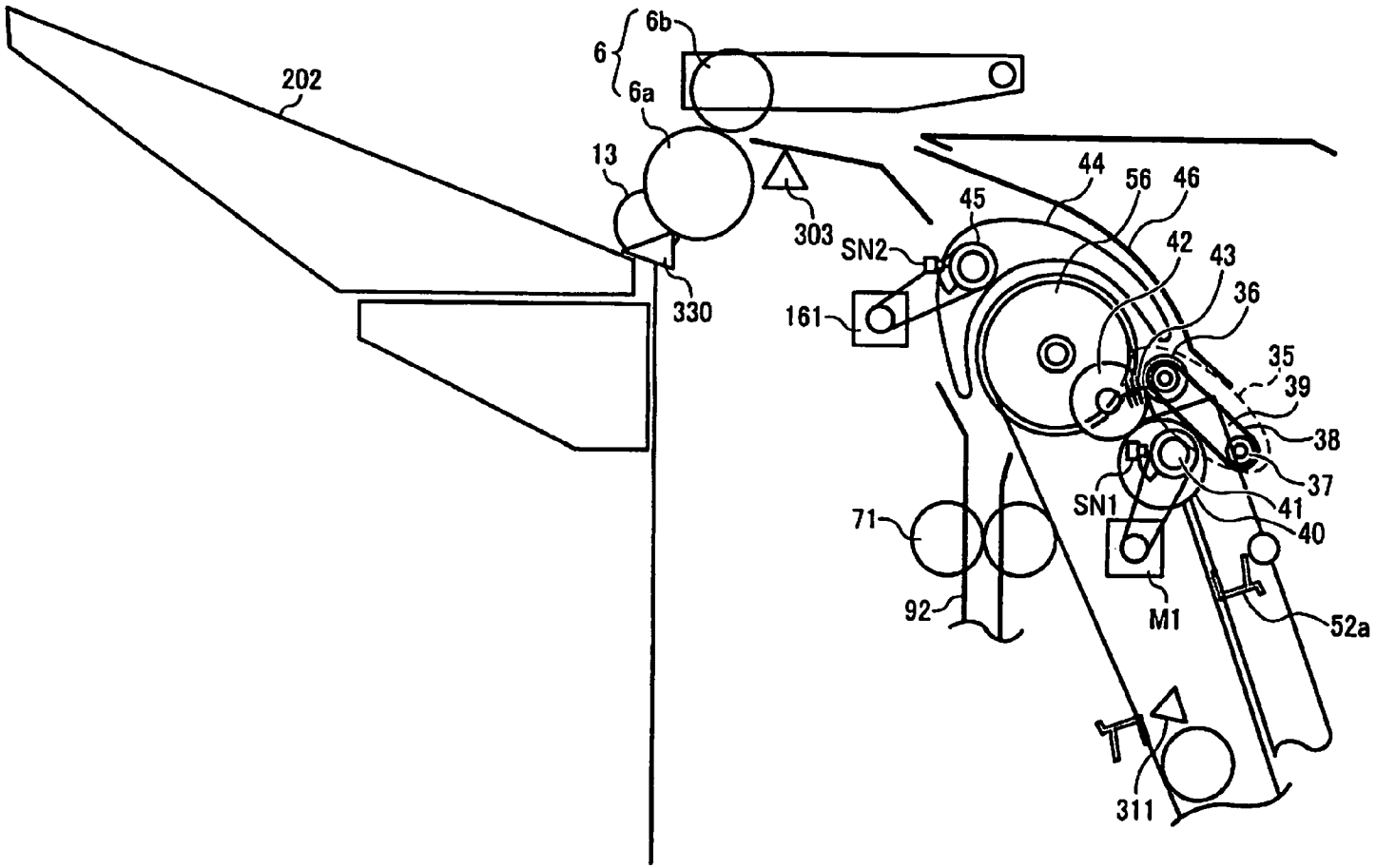
FIG. 15 is a schematic diagram for explaining a sheet-stack deflecting mechanism.

Subsequently, a sheet-stack deflecting mechanism is explained below. FIG. 15 is a diagram illustrating main elements of the sheet-stack deflecting mechanism.

Figure 16A:
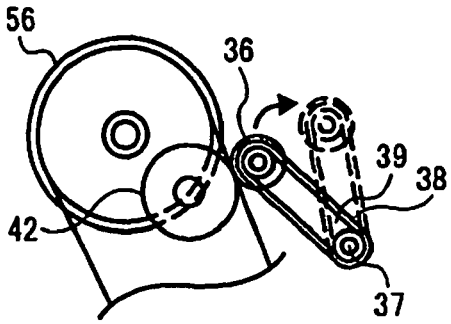
FIGS. 16A and 16B are schematic diagrams of examples of a sheet-stack conveying mechanism of the sheet-stack deflecting mechanism.
Figure 16B:
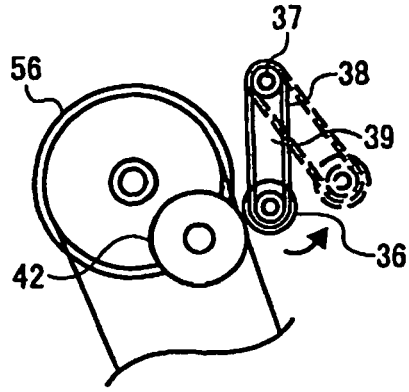

As shown in FIGS. 1 and 15, a conveying unit for conveying a stack of sheets to any of a conveying path connecting from the edge-binding processing tray F to the saddle-stitch processing tray G and a conveying path connecting from the edge-binding processing tray F to the shift tray 202 is composed of a conveying mechanism 35, the discharge rollers 56, and the guide member 44. The conveying mechanism 35 exerts a conveying power on the stack of sheets. The discharge rollers 56 turn the stack of sheets. The guide member 44 guides the stack of sheets to a turn conveying path 57 (see FIG. 18). As shown in FIG. 15, a drive force of a drive shaft 37 is transmitted to a roller 36 of the conveying mechanism 35 via a timing belt 38. The roller 36 is connected to the drive shaft 37 via an arm 39, and swingably supported so as to swing around the drive shaft 37 as a supporting shaft. The roller 36 is driven to swing by a cam 40. The cam 40 is driven to rotate around a rotation axis 41 by a motor M1. A home position of the cam 40, which causes the conveying mechanism 35 to rotate and move, is detected by a sensor SN1. An angle of rotation from the home position can be controlled by additionally installing a sensor on the mechanism shown in FIG. 15, or can be adjusted by a pulse control of the motor M1. Incidentally, as a configuration of the conveying mechanism 35, there are mainly two types of configurations as shown in FIGS. 16A and 16B. In the configuration shown in FIG. 16A, the drive shaft 37 is arranged on the upstream side of the sheet conveying direction. On the other hand, in the configuration shown in FIG. 16B, the drive shaft 37 is arranged on the downstream side of the sheet conveying direction. Either configuration can be employed depending on a layout of other mechanism.

Figure 17:
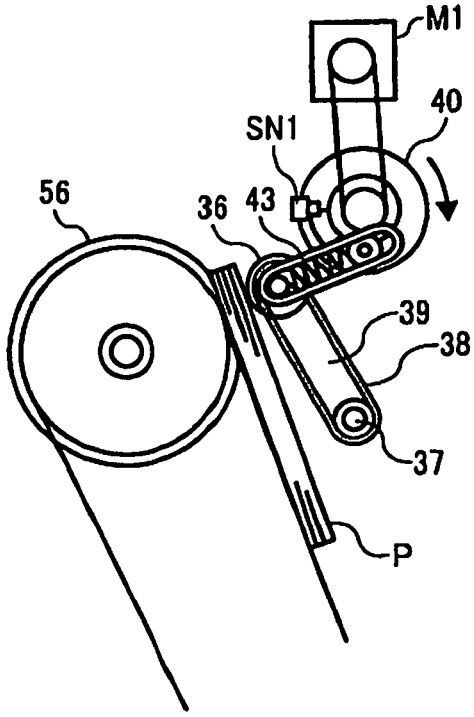
FIG. 17 is a schematic diagram of another example of the sheet-stack conveying mechanism of the sheet-stack deflecting mechanism.
Figure 18A:
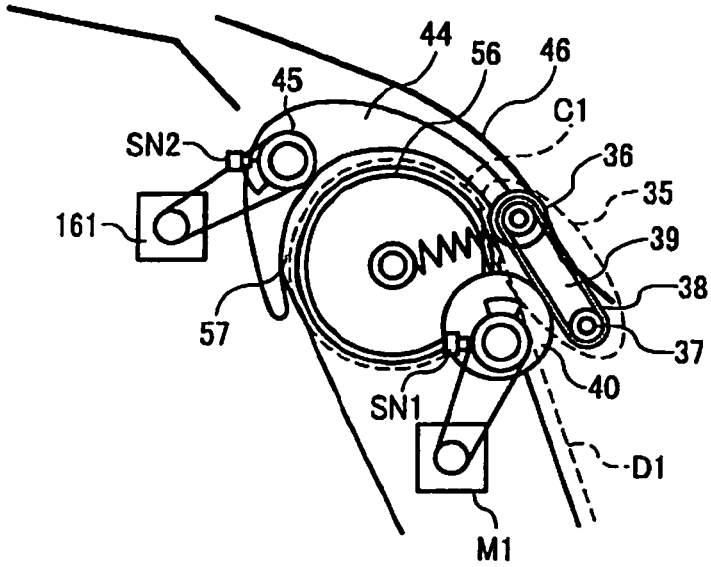
FIGS. 18A and 18B are schematic diagrams for explaining an operation in each of cases where a sheet is conveyed toward the shift tray with and without being deflected by the sheet-stack deflecting mechanism.

In the conveying mechanism 35, a driven roller 42 is arranged to be opposed to the roller 36. A stack of sheets is conveyed in such a state that the stack of =sheets is sandwiched between the driven roller 42 and the roller 36 and pressurized by an elastic member 43. As a thickness of a stack of sheets P increases, a higher conveying power, i.e., a higher pressure is required. Therefore, as shown in FIG. 17, the roller 36 is configured to be pressed on the cam 40 via the elastic member 43. The pressure can be adjusted by changing an angle of the cam 40 with respect to the roller 36. Alternatively, as shown in FIG. 18A, instead of the driven roller 42, the discharge roller 56 can be arranged to be opposed to the roller 36. In this case, a position of a nip portion formed between the roller 36 and the discharge roller 56 is preferably located near a contact point between a trajectory D1 of the stack of sheets and a concentric circle C1 of the discharge roller 56.

Figure 18B:
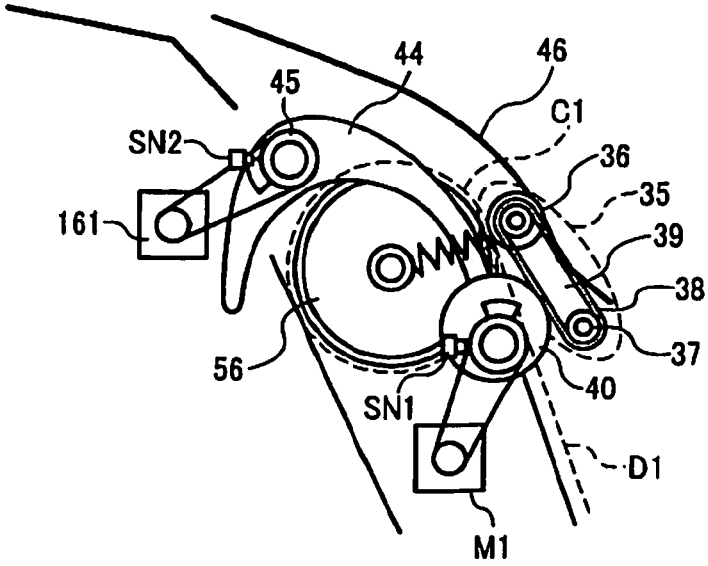

The turn conveying path 57 used for conveying a stack of sheets from the edge-binding processing tray F to the saddle-stitch processing tray G is formed between the discharge roller 56 and an inner surface of the guide member 44 opposed to the discharge roller 56. The guide member 44 is driven to rotate around a supporting point 45 by a stack branching drive motor 161. A home position of the guide member 44 is detected by a sensor SN2. As the conveying path for conveying a stack of sheets from the edge-binding processing tray F to the shift tray 202, as shown in FIG. 18B, a space formed between an outer surface of the guide member 44 (on the opposite side of which opposed to the discharge roller 56) and a guide plate 46 by clockwise rotation of the guide member 44 around the supporting point 45 is used.

FIGS. 19 to 22 are diagrams for explaining a basic operation of the sheet-stack deflecting mechanism. The sheet-stack deflecting mechanism is composed of the conveying mechanism 35, the guide member 44, and the discharge roller 56.

Figure 19:
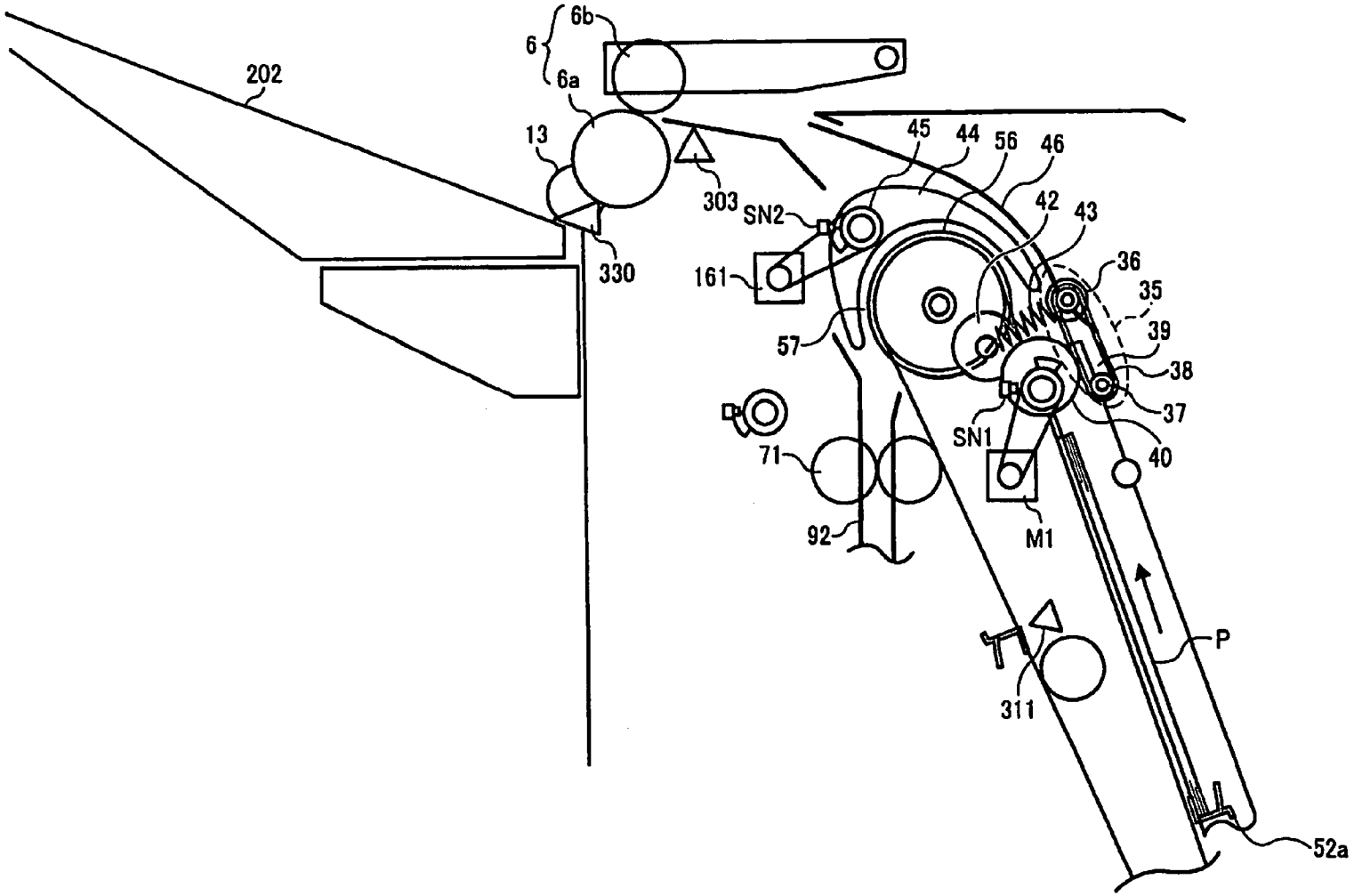
FIG. 19 is a schematic diagram showing a state where a trailing end portion of a stack of sheets aligned by an edge-binding processing unit is pressed up by the discharge claw.

When a stack of sheets P is conveyed from the edge-binding processing tray F to the saddle-stitch processing tray G, as shown in FIG. 19, a trailing end portion of the stack of sheets P aligned in the edge-binding processing tray F is pressed up by the discharge claws 52*a* so that the stack of sheets P is sandwiched between the roller 36 and the driven roller 42 and conveyed to the saddle-stitch processing tray G. At this time, the roller 36 stands by at such a position that the roller 36 does not collide against a leading end portion of the stack of sheets P.

Figure 20A:
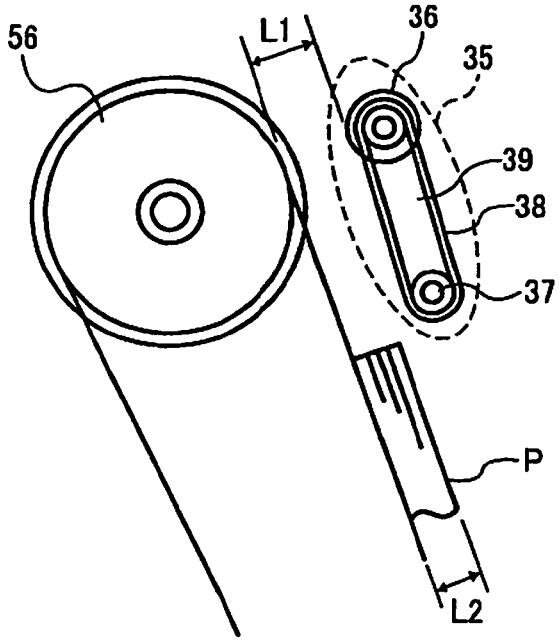
FIGS. 20A and 20B are schematic diagrams for explaining an operation of a mechanism for preventing a sheet jam when a stack of sheets is conveyed.
Figure 20B:
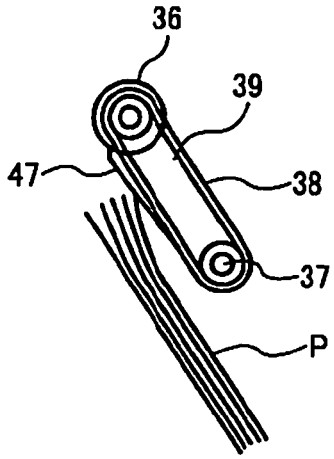

As shown in FIG. 20A, a distance L1 between the roller 36 and a surface of the edge-binding processing tray F on which the stack of sheets P is stacked when the stack of sheets P is aligned in the edge-binding processing tray F or a surface to which the stack of sheets P is guided when the trailing end portion of the stack of sheets P is pressed up by the discharge claws 52*a* is set up to be larger than a maximum thickness of the stack of sheets P to be conveyed from the edge-binding processing tray F to the saddle-stitch processing tray G, and thereby preventing a collision of the leading end portion of the stack of sheets P with the roller 36. The thickness of the stack of sheets P varies depending on the number of sheets aligned in the edge-binding processing tray F or a type (quality) of the sheets, so that a position of the roller 36 to be essentially positioned to prevent a collision with the leading end portion of the stack of sheets P also varies. Therefore, the roller 36 is configured to be retracted based on information on the number of the sheets or the type (quality) of the sheets. As a result, a time that the roller 36 takes to move between the stand-by position and a position where the roller 36 presses on the stack of sheets P to convey the stack of sheets can be minimized, and thus the productivity can be improved. Such information on the number of the sheets or the type (quality) of the sheets can be based on job information from the image forming apparatus PR, or the conveying mechanism 35 can be configured to obtain the information from the sensor in the sheet post-processing apparatus PD. However, if the stack of sheets P aligned in the edge-binding processing tray F is unexpectedly curled up, when the stack of sheets P is pressed up by the discharge claws 52*a*, the leading end portion of the stack of sheets P may comes in contact with the roller 36. Therefore, as shown in FIG. 20B, a guide 47 is provided in front of the roller 36, whereby a contact angle of the leading end portion of the stack of sheets P with respect to the roller 36 can be lessened. The guide 47 can be made of either a firm member or an elastic member. In either case, the same effect can be obtained.

Figure 21:
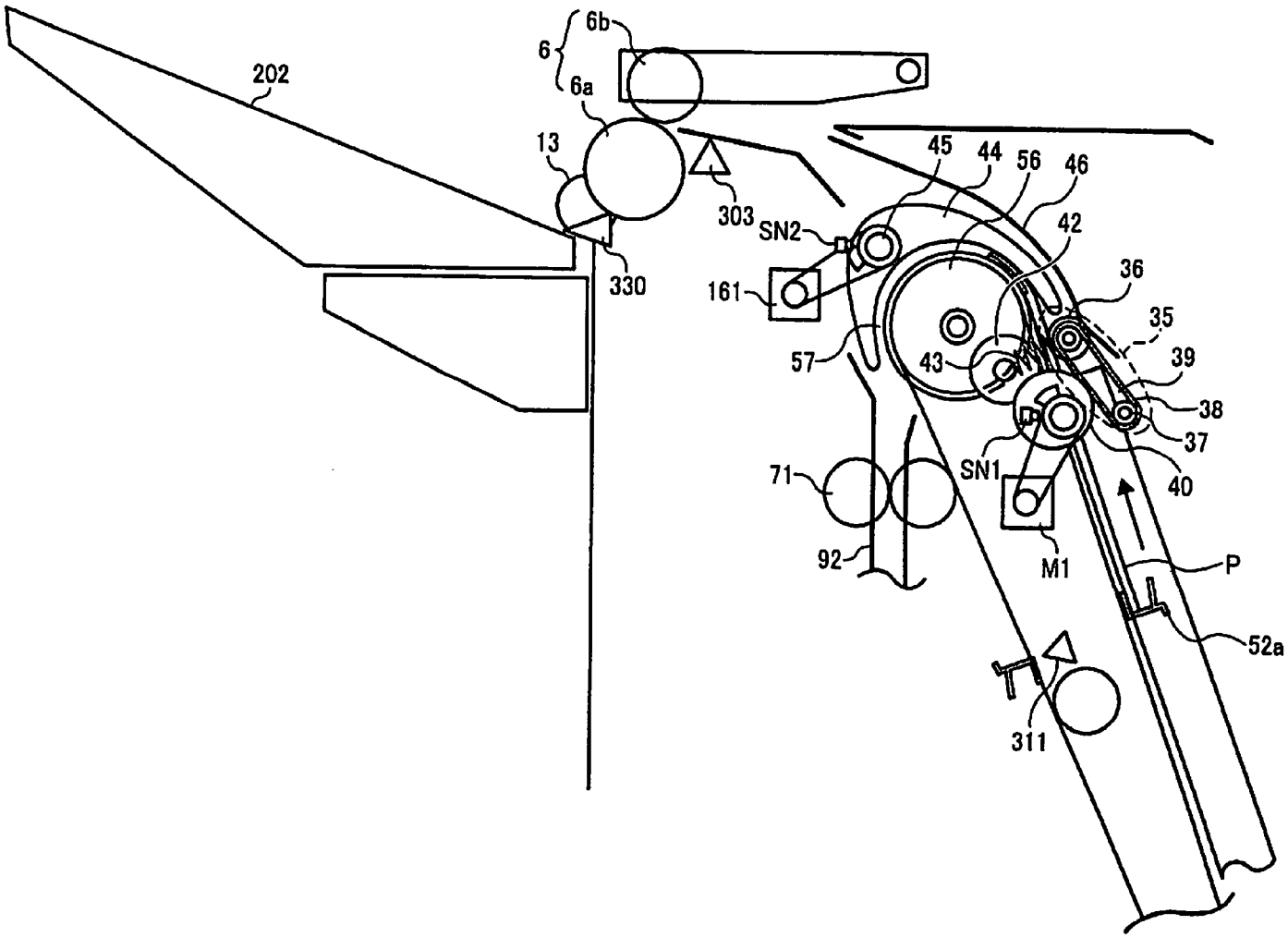
FIG. 21 is a schematic diagram for explaining an operation for exerting a conveying force on a stack of sheets when the stack of sheets is deflected in such a manner that upon passage of a leading end portion of the stack of sheets, a roller as a conveying unit is pressed on a surface of the stack of sheets.

Then, as shown in FIG. 21, after the leading end portion of the stack of sheets P passes through between the roller 36 and the driven roller 42, the roller 36 is pressed on the surface of the stack of sheets P so as to convey the stack of sheets P. At this time, the guide member 44 and the discharge roller 56 serve as a guide member, and guide the stack of sheets P to the saddle-stitch processing tray G on the downstream.

Figure 22:
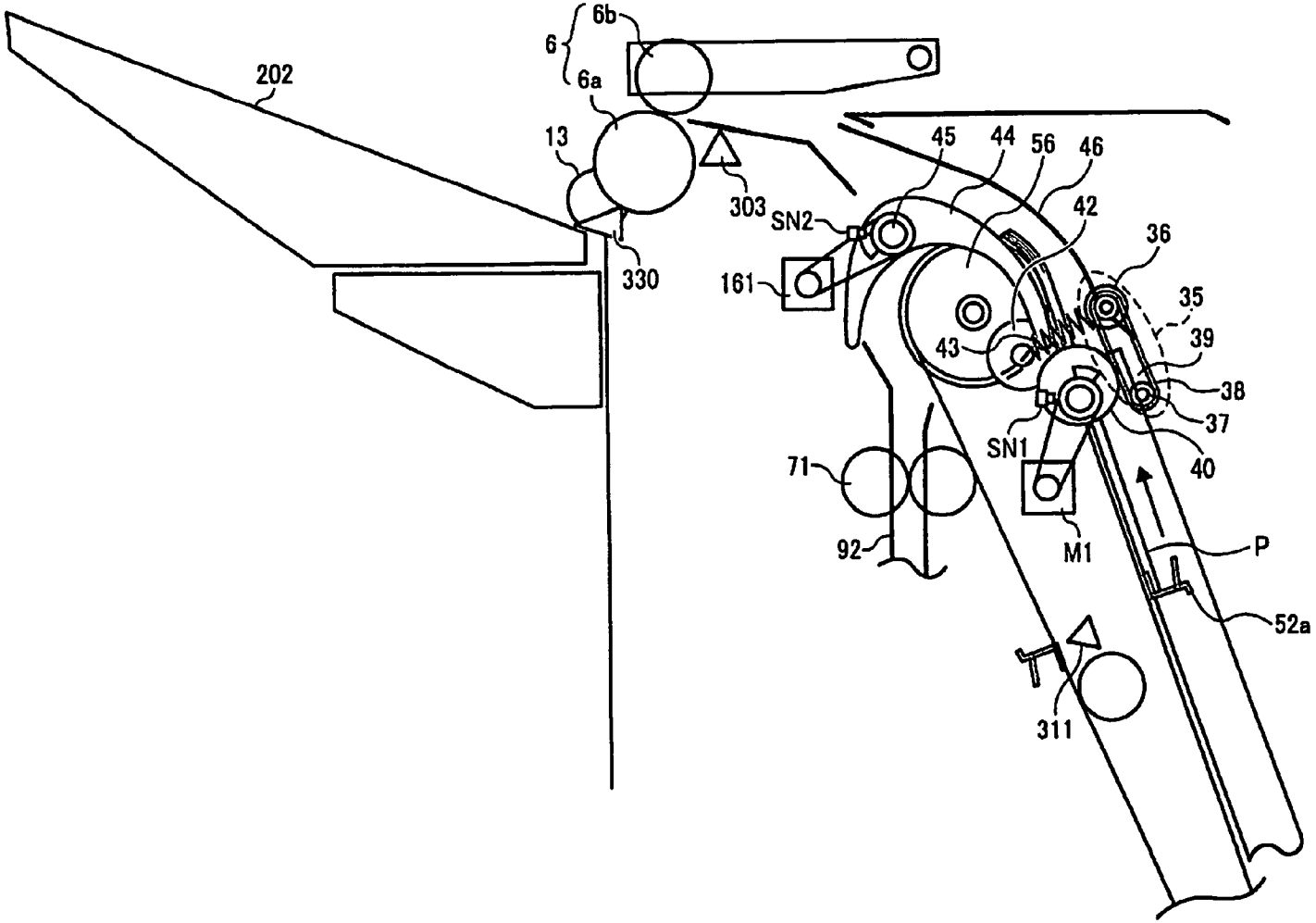
FIG. 22 is a schematic diagram for explaining such an operation that a guide member is rotated to form a conveying path connecting to the shift tray by the guide member and a guide plate, and a trailing end portion of a stack of sheets aligned by the edge-binding processing unit is pressed up by the discharge claw to convey the stack of sheets to the shift tray.

When the stack of sheets P is conveyed from the saddle-stitch processing tray G to the shift tray 202, as show in FIG. 22, the guide member 44 is further rotated clockwise from a state shown in FIG. 21, whereby the guide member 44 and the guide plate 46 form a conveying path connecting to the shift tray 202. Then, the stack of sheets P is conveyed to the shift tray 202 while the trailing end portion of the stack of sheets P aligned in the edge-binding processing tray F is pressed up by the discharge claws 52*a*. In this case, the roller 36 need not apply a pressure to the stack of sheets P.

Incidentally, in the present embodiment, the discharge roller 56 is not constrained by the drive shaft 52*b*, which drives the discharge belt 52 to move, and rotates in accordance with the movement of the conveyed stack of sheets P. Alternatively, the discharge roller 56 can be driven to rotate by the discharge motor 157. In this case, a circumferential speed of the discharge roller 56 is set up to be higher than that of the discharge belt 52.

Subsequently, a saddle-stitching process and a center-folding process are explained below. The saddle-stitching process and the center-folding process are performed in the saddle-stitch processing tray G located on the downstream side of the edge-binding processing tray F. A stack of sheets is guided from the edge-binding processing tray F to the saddle-stitch processing tray G by the sheet-stack deflecting mechanism.

A configuration of the saddle-stitch processing tray G is explained below. As shown in FIG. 1, the saddle-stitch processing tray G is arranged on the downstream side of the sheet-stack deflecting mechanism composed of the conveying mechanism 35, the guide member 44, and the discharge roller 56. The saddle-stitch processing tray G is nearly vertically-arranged on the downstream side of the sheet-stack deflecting mechanism. A folding mechanism is arranged in the center of the saddle-stitch processing tray G. A sheet-stack conveying upper guide plate 92 is arranged above the folding mechanism, and a sheet-stack conveying lower guide plate 91 is arranged below the folding mechanism. A pair of sheet-stack conveying upper rollers 71 is arranged above the sheet-stack conveying upper guide plate 92, and a pair of sheet-stack conveying lower rollers 72 is arranged below the sheet-stack conveying upper guide plate 92. The saddle-stitch upper jogger fence 250*a* is arranged along both side surfaces of the sheet-stack conveying upper guide plate 92 to straddle both the sheet-stack conveying rollers 71 and 72. Similarly, the saddle-stitch lower jogger fence 250*b* is arranged along both side surfaces of the sheet-stack conveying lower guide plate 91. The saddle-stitch binding stapler S2 is arranged on the saddle-stitch lower jogger fence 250*b*. The saddle-stitch upper jogger fences 250*a* and the saddle-stitch lower jogger fences 250*b* are driven to move by a drive mechanism (not shown), and align a stack of sheets in the direction perpendicular to the sheet conveying direction (the sheet width direction). The saddle-stitch binding stapler S2 is composed of two pairs of a clincher unit and a driver unit. The two pairs of the clincher unit and the driver unit are arranged in the sheet width direction with keeping a predetermined distance between them. In the present embodiment, the two pairs of the clincher unit and the driver unit, which are fixed at predetermined positions respectively, are used as the saddle-stitch binding stapler S2. Alternatively, one pair of the clincher unit and the driver unit can be used as the saddle-stitch binding stapler S2. In this case, when a stack of sheets is to be two-point bound, after the saddle-stitch binding stapler S2 binds the stack of sheets at one point, the saddle-stitch binding stapler S2 is moved in the sheet width direction, and binds the stack of sheets at the other point.

A movable trailing-end fence 73 is arranged to get across the sheet-stack conveying lower guide plate 91, and is driven to move in the sheet conveying direction (up and down in FIG. 1) by a travel mechanism. The travel mechanism includes a timing belt and a driving mechanism for driving the timing belt to move. The travel mechanism further includes a drive pulley, a driven pulley, and a stepping motor. The timing belt is supported by the drive pulley and the driven pulley. The drive pulley is driven by the stepping motor. A trailing-end tap claw 251 and a driving mechanism for driving the trailing-end tap claw 251 are arranged on the upstream side of the sheet-stack conveying upper guide plate 92. The trailing-end tap claw 251 is driven to move in a reciprocating manner in a direction of moving away from the sheet-stack deflecting mechanism and a direction of pressing on the trailing end portion of the stack of sheets (on the side corresponding to the trailing end of which when the stack of sheets is guided thereto) by a timing belt 252 and a driving mechanism (not shown). Incidentally, in FIG. 1, a reference numeral 326 denotes a trailing-end tap-claw HP sensor for detecting a home position of the trailing-end tap claw 251.

The center-folding mechanism is arranged in just about the center of the saddle-stitch processing tray G. The center-folding mechanism is composed of the folding plate 74, the folding rollers 81, and a conveying path H on which a stack of folded sheets is conveyed.

Figure 23A:
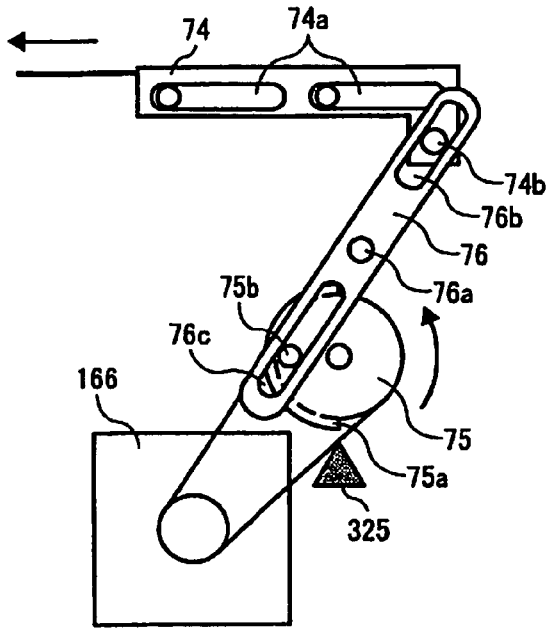
FIGS. 23A and 23B are schematic diagrams for explaining an operation of a center-folding mechanism.
Figure 23B:
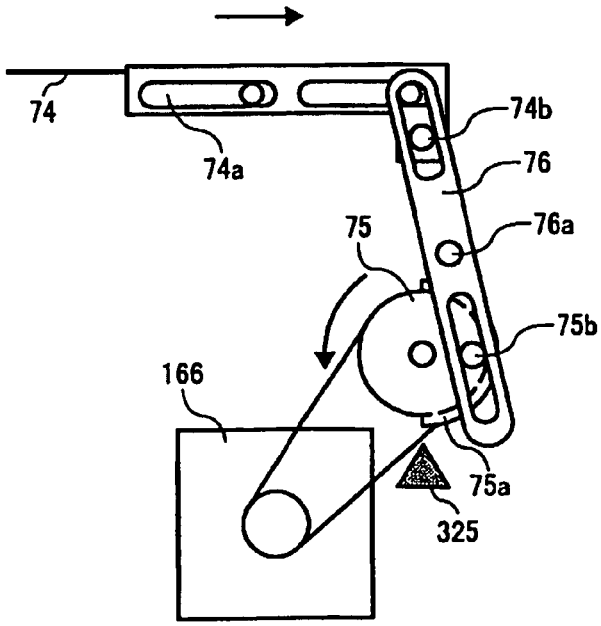
Figure 25:
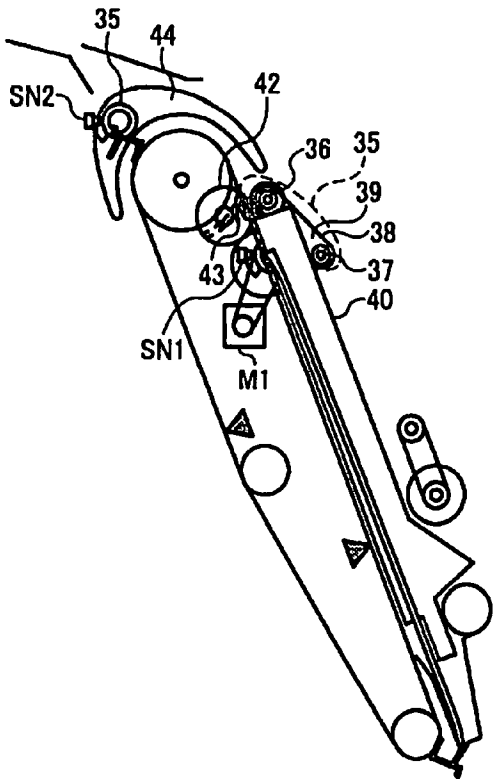
FIG. 25 is a schematic diagram showing a state where sheets are aligned and stacked on the edge-binding processing tray.

FIGS. 23A and 23B are diagrams for explaining an operation of a travel mechanism of the folding plate 74.

The folding plate 74 is movably supported by two shafts projecting from the front and back side plates in such a manner that each of the shafts is freely fitted into a corresponding long hole 74*a* formed on the folding plate 74, so that the folding plate 74 can move in a longitudinal direction of the long hole 74*a*. Furthermore, a shaft portion 74*b* of the folding plate 74 is =fitted into a long hole 76*b* formed on a link arm 76. When the link arm 76 swings around a supporting point 76*a*, the folding plate 74 moves in a reciprocating manner from side to side in FIGS. 23A and 23B. A long hole 76*c* is formed on the other end side of the link arm 76 to be symmetrical to the long hole 76*b* about the supporting point 76*a*. A shaft portion 75*b* of a folding-plate drive cam 75 is freely fitted into the long hole 76*c*, so that the link arm 76 swings in accordance with rotation of the folding-plate drive cam 75. The folding-plate drive cam 75 is driven to rotate in a direction of an arrow shown in FIGS. 23A and 23B by a folding-plate drive motor 166. The folding-plate drive cam 75 stops rotating when a folding-plate HP sensor 325 detects any of both ends of a semilunar shielding portion 75*a* of the folding-plate drive cam 75.

The folding plate 74 shown in FIG. 23A is located at a home position where the folding plate 74 is thoroughly retracted from a sheet-stack containing area of the saddle-stitch processing tray G. When the folding-plate drive cam 75 rotates in a direction of an arrow shown in FIG. 23A, the folding plate 74 moves in a direction of an arrow shown in FIG. 23A, and enters into the sheet-stack containing area of the saddle-stitch processing tray G. FIG. 23B shows a state of each of elements when a center of a stack sheets on the saddle-stitch processing tray G is pressed into a nip portion formed between the folding rollers 81. When the folding-plate drive cam 75 rotates in a direction of an arrow shown in FIG. 23B, the folding plate 74 moves in a direction of an arrow shown in FIG. 23B, whereby the folding plate 74 is retracted from the sheet-stack containing area of the saddle-stitch processing tray G.

In the present embodiment, a stack of sheets is center-folded to be saddle-stitched. However, the present invention can be applied to a case where one sheet is folded. In this case, the sheet need not to be saddle-stitched, so that when the sheet is discharged from the image forming apparatus PR, the sheet is conveyed to the saddle-stitch processing tray G, and folded by the folding plate 74 and the folding rollers 81, and then discharged onto the lower tray 203 through a pair of discharge rollers 83. Incidentally, in FIG. 1, a reference numeral 323 denotes a folding-unit passing sensor for detecting whether a folded sheet passes therethrough, a reference numeral 321 denotes a sheet-stack detecting sensor for detecting whether a stack of sheets reaches a center-folding position, and a reference numeral 322 denotes a movable trailing-end fence HP sensor for detecting a home position of the movable trailing-end fence 73.

Furthermore, in the present embodiment, a detection lever 501 for detecting a height of a stack of center-folded sheets stacked on the lower tray 203 is swingably provided on the lower tray 203. The detection lever 501 swings around a supporting point 501*a*. An angle of the detection lever 501 is detected by a sheet-face sensor 505 so as to control the lower tray 203 to be lifted up and down and to perform an overflow detection.

In the present embodiment, a sheet is discharged in any of following five post-processing modes. The post-processing modes are as follows:

Non-stapling mode A: A sheet is discharged onto the upper tray 201 through the conveying paths A and B.

Non-stapling mode B: A sheet is discharged onto the shift tray 202 through the conveying paths A and C.

Sorting/stacking mode: A sheet is discharged onto the shift tray 202 through the conveying paths A and C. Upon receiving continuously-discharged sheets, the shift tray 202 sorts the discharged sheets by oscillating the discharged sheets alternately in a sheet discharging direction and a direction perpendicular to the sheet discharging direction by each break.

Stapling mode: A stack of sheets is conveyed to the edge-binding processing tray F through the conveying paths A and D, aligned and bound in the edge-binding processing tray F, and discharged onto the shift tray 202 through the conveying path C.

Saddle-stitch binding mode: A stack of sheets is conveyed to the edge-binding processing tray F through the conveying paths A and D, aligned and saddle-stitched in the edge-binding processing tray F, conveyed to the processing tray G, center-folded in the processing tray G, and discharged onto the lower tray 203 through the conveying path H.

An operation in each of the modes is explained below.

[1] Operation in Non-Stapling Mode A

A sheet is guided from the conveying path A to the conveying path B by the branch claw 15, and discharged onto the upper tray 201 by the conveying rollers 3 and the discharge rollers 4. Furthermore, a state of the discharge of the sheet is monitored by an upper discharge sensor 302 located near the discharge rollers 4.

[2] Operation in Non-Stapling Mode B

A sheet is guided from the conveying path A to the conveying path C by the branch claws 15 and 16, and discharged onto the shift tray 202 by the conveying rollers 5 and the shift discharge rollers 6. Furthermore, a state of the discharge of the sheet is monitored by the discharge sensor 303 located near the shift discharge rollers 6.

[3] Operation in Sorting/Stacking Mode

A sheet is conveyed and discharged in the same manner as the operation in the non-stapling mode B. Upon receiving continuously-discharged sheets, the shift tray 202 sorts the discharged sheets by oscillating the discharged sheets alternately in the sheet discharging direction and the direction perpendicular to the sheet discharging direction by each break.

[4] Operation in Stapling Mode

A sheet is guided from the conveying path A to the conveying path D by the branch claws 15 and 16, and discharged onto the edge-binding processing tray F by the conveying rollers 7, the conveying rollers 9, the conveying rollers 10, and the staple discharge rollers 11. In the edge-binding processing tray F, the sheets sequentially-discharged thereon by the staple discharge rollers 11 are aligned, and when the predetermined number of the sheets are stacked, the edge binding stapler S1 binds an edge portion of the sheets. After that, a stack of the bound sheets is conveyed on the downstream by the discharge claw 52*a*, and discharged onto the shift tray 202 by the shift discharge rollers 6. Furthermore, a state of the discharge of the stack of the sheets is monitored by the discharge sensor 303 located near the shift discharge rollers 6.

[4-1] Discharging Process After Stapling Sheets

When the stapling mode is selected, as shown in FIG. 6, each of the jogger fences 53 moves from the home position, and stands by at the stand-by position located by 7 millimeters (mm) away from each side end of the sheet discharged onto the edge-binding processing tray F in the width direction. When the sheet is conveyed by the staple discharge rollers 11, and a trailing end of the sheet passes by a staple discharge sensor 305, each of the jogger fences 53 moves inward by 5 mm from the stand-by position, and then stops moving. Specifically, when the trailing end of the sheet passes by the staple discharge sensor 305, the staple discharge sensor 305 detects the passing of the trailing end of the sheet, and outputs a detection signal to a central processing unit (CPU) 360 (see FIG. 33). Upon receiving the detection signal, the CPU 360 starts counting up the number of pulses output from a staple conveying motor (not shown) that drives the staple discharge rollers 11. When the predetermined number of pulses is output from the staple conveying motor, the CPU 360 turns on the tap solenoid 170. The return roller 12 swings like a pendulum by on/off operation of the tap solenoid 170. When the tap solenoid 170 is turned on, the tap solenoid 170 taps the sheet to push back the sheet downward to be struck on the trailing-end fence 51, whereby the sheet is aligned. Each time a sheet to be contained in the edge-binding processing tray F passes by the inlet sensor or the staple discharge sensor 305, a detection signal is output to the CPU 360 by the sensor, so that the CPU 360 can count up the number of sheets stacked on the edge-binding processing tray F.

After a lapse of a predetermined time from when the tap solenoid 170 is turned off, each of the jogger fences 53 further moves inward by another 2.6 mm, and stops moving temporarily, whereby a lateral alignment of the sheet is completed. After that, each of the jogger fences 53 moves back outward by 7.6 mm to stand by for a subsequent sheet at the home position. Such an operation is repeated until the last sheet of the stack is conveyed and aligned. Then, each of the jogger fences 53 moves again inward by 7 mm, and stops moving so as to press on both side end portions of the stack of sheets to stand by for a process of binding the stack of sheets. After a lapse of a predetermined time, the edge binding stapler S1 is activated by a staple motor (not shown), and performs the binding process on the stack of sheets. At this time, if it is specified to bind the stack of sheets at two or more points, after the binding process for the first point is finished, the stapler travel motor 159 is driven thereby moving the edge binding stapler S1 to a predetermined position along the trailing end portion of the stack of sheets, and the staple-binding process for the second point is performed. If it is specified to bind the stack of sheets at three or more points, the above process is repeated.

Upon completion of the binding process, the discharge motor 157 is driven, and thereby driving the discharge belt 52 to move. At the same time, the sheet discharge motor is also driven, and the shift discharge rollers 6 start rotating to receive the stack of sheets pressed up by the discharge claw 52*a*. At this time, the jogger fences 53 are controlled to be moved depending on a sheet size and the number of the bound sheets. For example, when the number of the stack of bound sheets is smaller than the preset number of sheets or the sheet size of which is smaller than a preset sheet size, the stack of sheets is conveyed in such a manner that the trailing end portion of the stack of sheets is hooked on the discharge claw 52*a* while the stack of sheets is pressed by the jogger fences 53. After the predetermined number of pulses is output from a time of the detection by the sheet detecting sensor 310 or the discharge-belt HP sensor 311, each of the jogger fences 53 is moved outward by 2 mm to release the stack of sheets from the constraint of the jogger fences 53. The predetermined number of pulses is set up to cover a time from when the discharge claw 52*a* comes in contact with the trailing end portion of the stack of sheets to when the trailing end portion of the stack of sheets passes through a leading end of each of the jogger fences 53. On the other hand, when the number of the stack of bound sheets is larger than the preset number of sheets or the sheet size of which is larger than the preset sheet size, each of the jogger fences 53 is moved outward by 2 mm in advance, and the stack of sheets is discharged. In either case, when the stack of sheets passes through the jogger fences 53 thoroughly, each of the jogger fences 53 is further moved outward by another 5 mm to be located at the home position, and stand by for a subsequent sheet to be conveyed thereto. Incidentally, a constraint force of the jogger fences 53 to be applied to a stack of sheets can be adjusted by changing a distance of each of the jogger fences 53 to the stack of sheets.

[5] Operation in Saddle-Stitch Binding Mode

Figure 24:
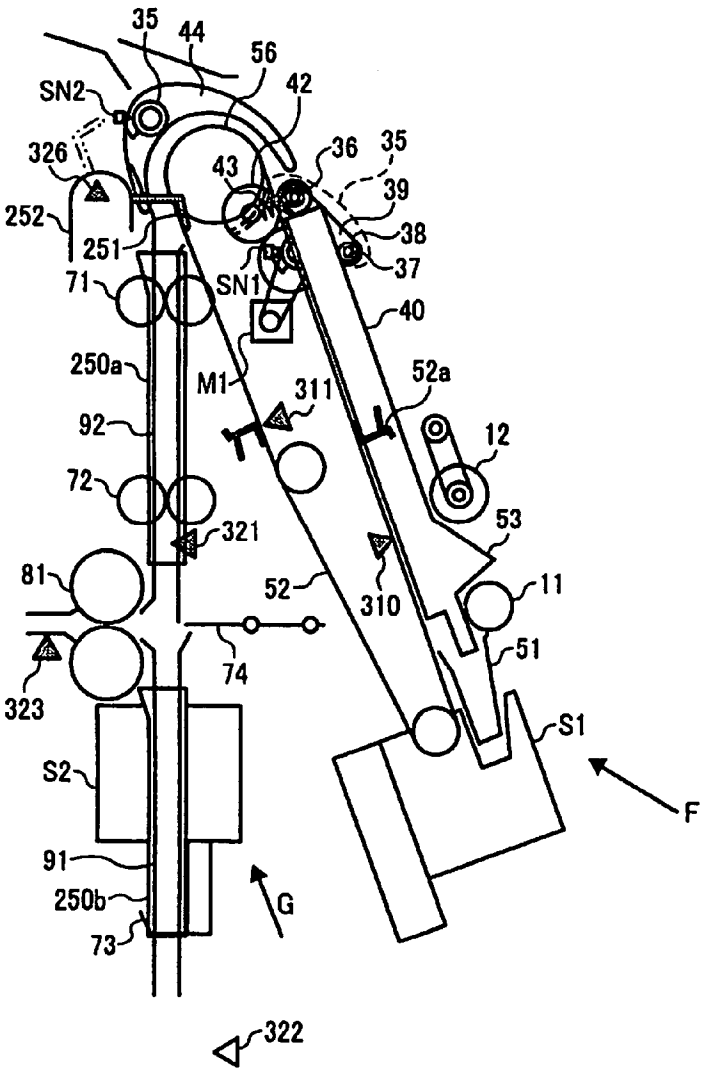
FIG. 24 is a front view of the edge-binding processing tray and a saddle-stitch processing tray.

FIG. 24 is a front view of the edge-binding processing tray F and the processing tray G. FIGS. 25 to 32 are diagrams for explaining an operation in the saddle-stitch binding mode.

A stack of sheets is guided from the conveying path A to the conveying path D by the branch claws 15 and 16, and discharged onto the edge-binding processing tray F by the conveying rollers 7, the conveying rollers 9, the conveying rollers 10, and the staple discharge rollers 11 (see FIG. 1). As shown in FIG. 24, in the same manner as the operation in the stapling mode, i.e., the operation just before the stack of sheets is stapled, sheets are sequentially discharged onto the edge-binding processing tray F by the staple discharge rollers 11, and a trailing end portion of the stack of sheets is aligned by the trailing-end fence 51 (see FIG. 25).

Figure 27:
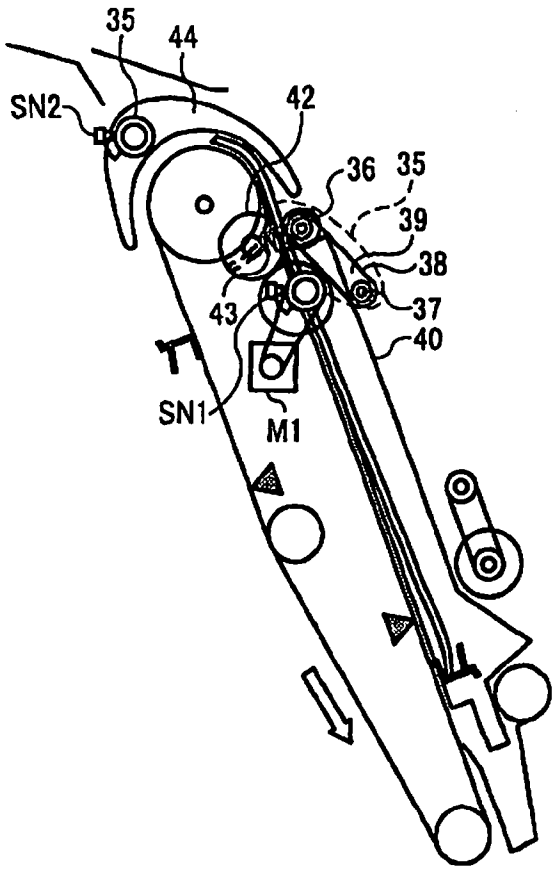
FIG. 27 is a schematic diagram showing an initial state where the stack of sheets shown in FIG. 26 is guided to the sheet-stack deflecting mechanism.
Figure 26:
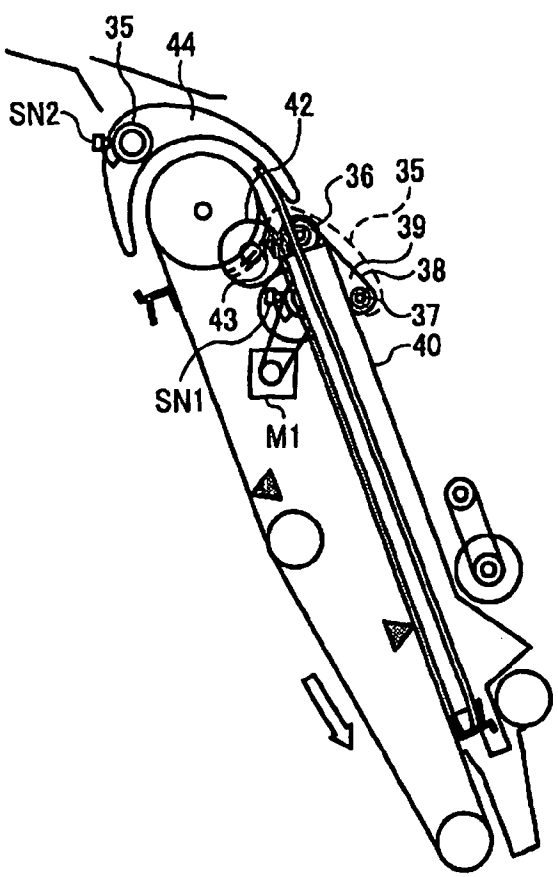
FIG. 26 is a schematic diagram showing a state where the stack of sheets shown in FIG. 25 is pressed up by the discharge claw.

After the stack of sheets is temporarily aligned in the edge-binding processing tray F, as shown in FIG. 26, a leading end portion of the stack of sheets is pressed up by the discharge claw 52*a*, and passes through between the driven roller 42 and the roller 36, which is retracted outward so that the roller 36 does not interfere with the leading end portion of the stack of sheets. Then, the stack of sheets enters toward a position where the inner surface of the guide member 44 is opposed to an outer circumferential surface of the discharge roller 56. The roller 36 is moved close to the driven roller 42 by the motor M1 and the cam 40 so that the leading end portion of the stack of sheets is sandwiched between the roller 36 and the driven roller 42 at a predetermined pressure. The roller 36 starts rotating by a drive force transmitted from the timing belt 38. As a result, as shown in FIG. 27, the stack of sheets is conveyed to the downstream side along the path guiding to the saddle-stitch processing tray G by the rotation of the discharge roller 56. The discharge roller 56 is provided on a drive shaft of the discharge belt 52, and is driven to rotate in synchronization with the discharge belt 52.

Figure 29:
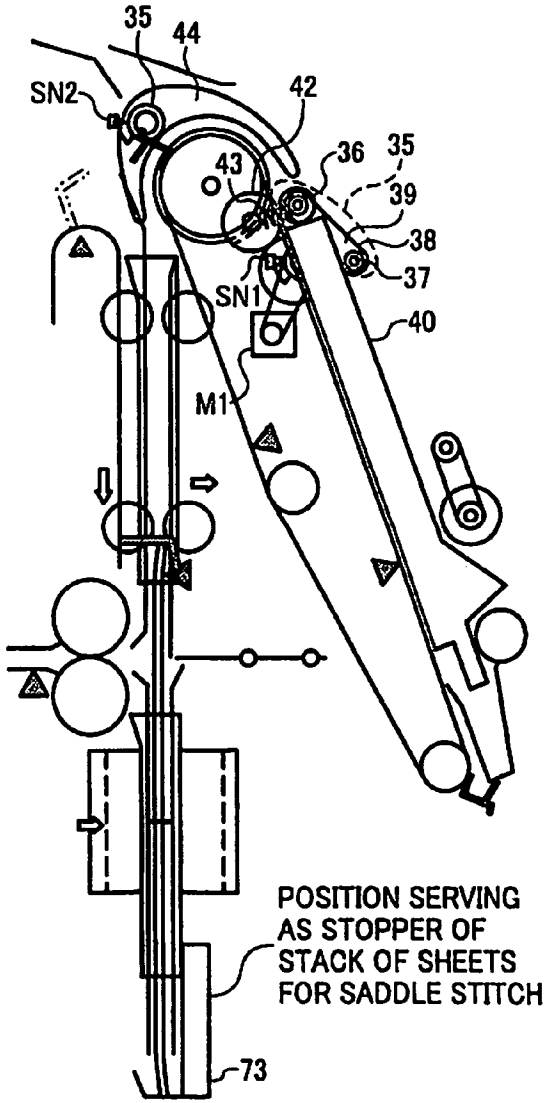
FIG. 29 is a schematic diagram showing a state where the stack of sheets shown in FIG. 28 is conveyed to the center-folding processing tray, and aligned therein.
Figure 28:
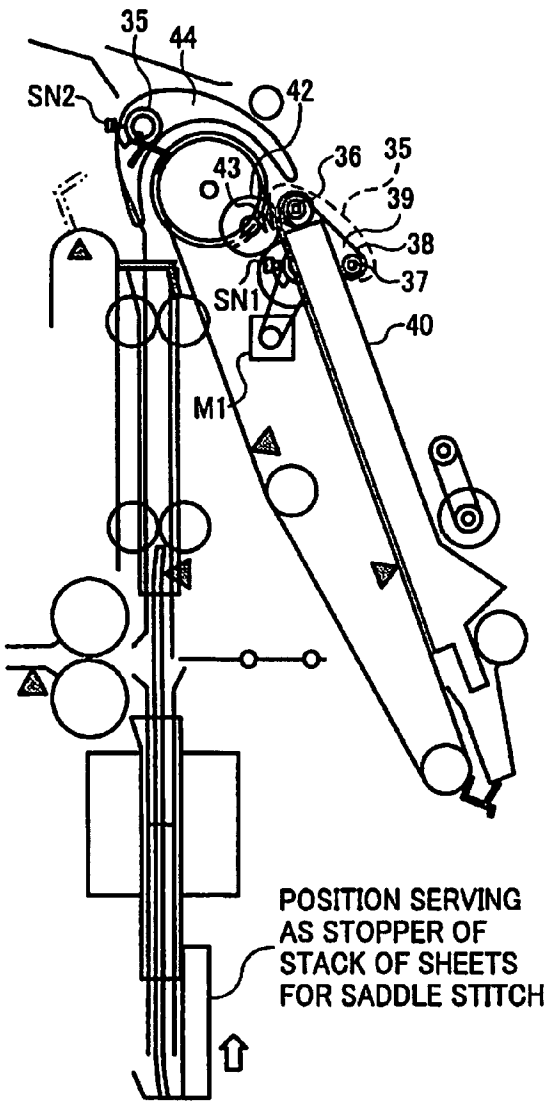
FIG. 28 is a schematic diagram showing a state where the stack of sheets shown in FIG. 27 is conveyed to a center-folding processing tray.

The stack of sheets is conveyed from a position shown in FIG. 27 to a position shown in FIG. 28. When the stack of sheets enters into the saddle-stitch processing tray G, the sheets is conveyed by the sheet-stack conveying upper rollers 71 and the sheet-stack conveying lower rollers 72. At this time, the movable trailing-end fence 73 stands by at a different position depending on a size of the stack of sheets in the conveying direction. When the leading end portion of the stack of sheets comes in contact with the movable trailing-end fence 73 and is stuck therein, the pressure by the sheet-stack conveying lower rollers 72 is released as shown in FIG. 28, and the trailing end portion of the stack of sheets is tapped by the trailing-end tap claw 251 as shown in FIG. 29, whereby a final alignment of the stack of sheets in the conveying direction is performed. This is because there is a possibility that any of the sheets of the stack temporarily-aligned in the edge-binding processing tray F is misaligned till the stack of sheets is stuck in the movable trailing-end fence 73. Therefore, the final alignment of the stack of sheets needs to be performed by the trailing-end tap claw 251.

A position of the movable trailing-end fence 73 shown in FIG. 29 is a saddle-stitch position. The movable trailing-end fence 73 stands by at the saddle-stitch position. The movable trailing-end fence 73 is moved by the saddle-stitch upper jogger fences 250*a* and the saddle-stitch lower jogger fences 250*b* when the stack of sheets is finally aligned in the width direction. Then, a center portion of the stack of sheets is bound by the saddle-stitch binding stapler S2. Incidentally, a position of the movable trailing-end fence 73 is determined by a pulse control of the movable trailing-end fence HP sensor 322, and a position of the trailing-end tap claw 251 is determined by a pulse control of the trailing-end tap-claw HP sensor 326.

Figure 30:
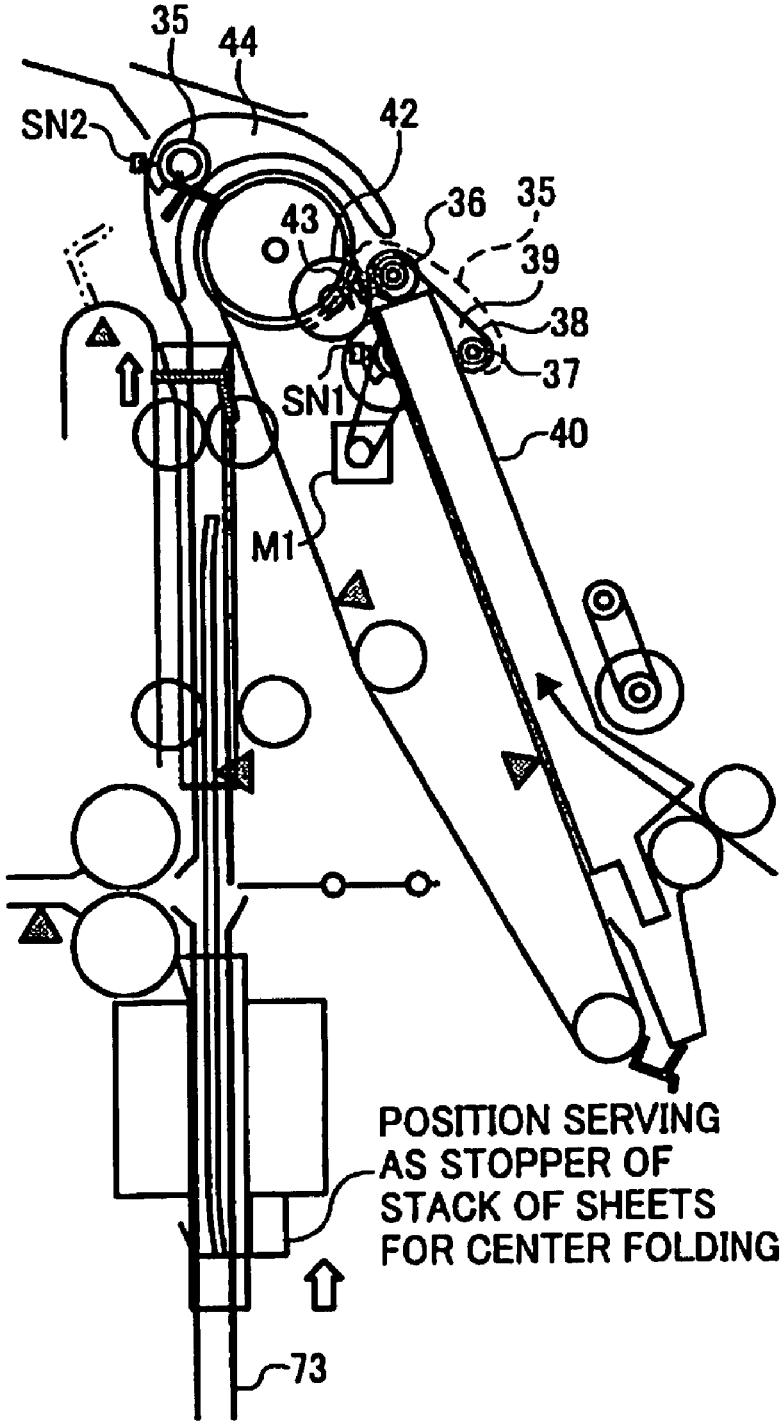
FIG. 30 is a schematic diagram showing a state where the stack of sheets shown in FIG. 29 is pressed up to a center-folding position.
Figure 31:
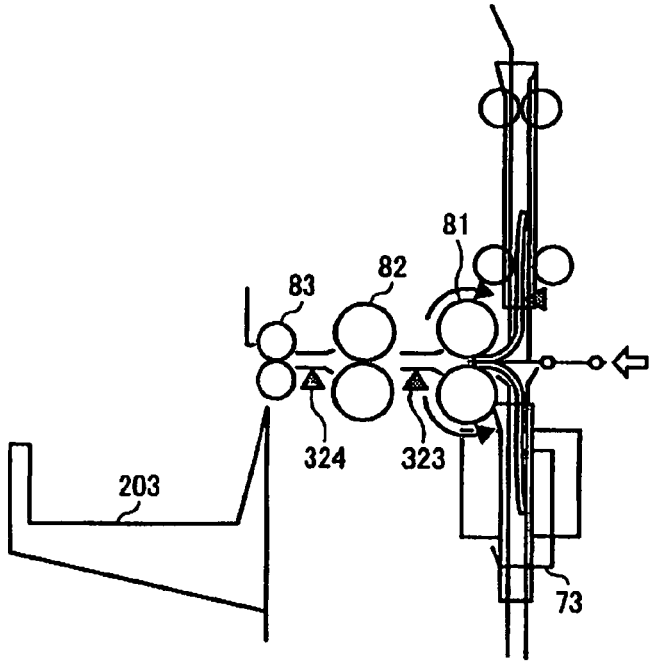
FIG. 31 is a schematic diagram showing a state where a center-folding process on the stack of sheets shown in FIG. 30 is started.

As shown in FIG. 30, the stack of the saddle-stitched sheets is conveyed upward so that a center-folding position of which comes to a corresponding position of the folding plate 74 in accordance with the movement of the movable trailing-end fence 73 while the pressure by the sheet-stack conveying lower rollers 72 is released. After that, as shown in FIG. 31, near a staple-bound portion of the stack of sheets is pressed by the folding plate 74 in a substantially perpendicular direction. The stack of sheets is guided to a nip portion formed between the folding rollers 81 arranged in a traveling direction of the folding plate 74. The folding rollers 81, which start rotating preliminarily, hold the stack of sheets therebetween, and convey the stack of sheets with applying a pressure to the stack of sheets, whereby the center portion of the stack of sheets is folded. In this manner, when the stack of the saddle-stitched sheets is conveyed upward for center-folding processing, the stack of sheets can be certainly conveyed by the movement of the movable trailing-end fence 73 only. If the stack of sheets is conveyed downward for folding processing, there is not enough certainty to convey the stack of sheets by the use of the movement of the movable trailing-end fence 73 only. To cope with this issue, it is necessary to provide a conveying roller or the like, so that a configuration becomes disadvantageously complicated.

Figure 32:
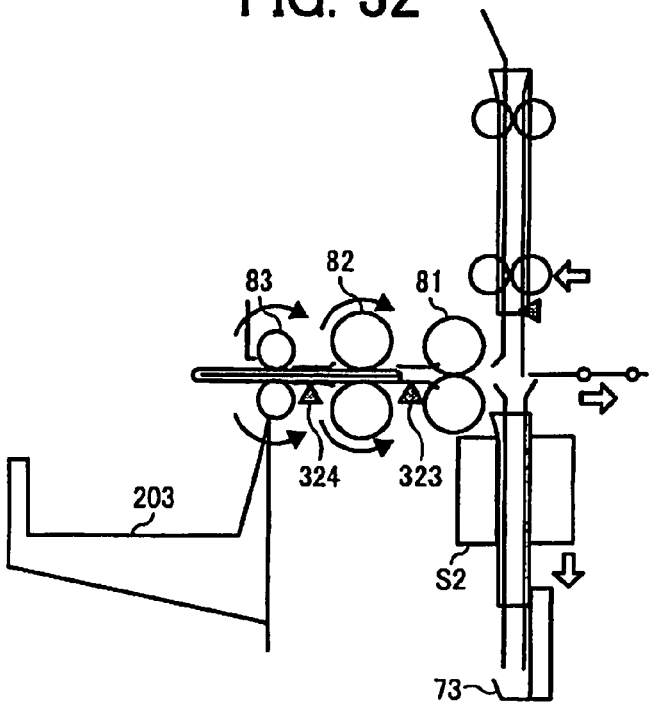
FIG. 32 is a schematic diagram showing a state where a crease of the stack of sheets shown in FIG. 31 is deepened at a position of folding rollers.

As shown in FIG. 32, a crease of the stack of the folded sheets is deepened by a pair of second folding rollers 82, and discharged onto the lower tray 203 through the discharge rollers 83. At this time, when the trailing end portion of the stack of sheets is detected by the folding-unit passing sensor 323, to stand by for a subsequent sheet to be conveyed, the folding plate 74 and the movable trailing-end fence 73 are respectively moved back to the home position, and the pressure by the sheet-stack conveying lower rollers 72 is again applied. Incidentally, if a subject of a next job is a stack of the same number of sheets having the same sheet size, the movable trailing-end fence 73 can be moved to a position shown in FIG. 24 to stand by for the next job. The second folding rollers 82 shown in FIGS. 31 and 32 are not depicted in FIG. 1. Whether the second folding rollers 82 are to be installed is determined depending on a design condition. A reference numeral 324 denotes a discharging sheet sensor.

Figure 33:
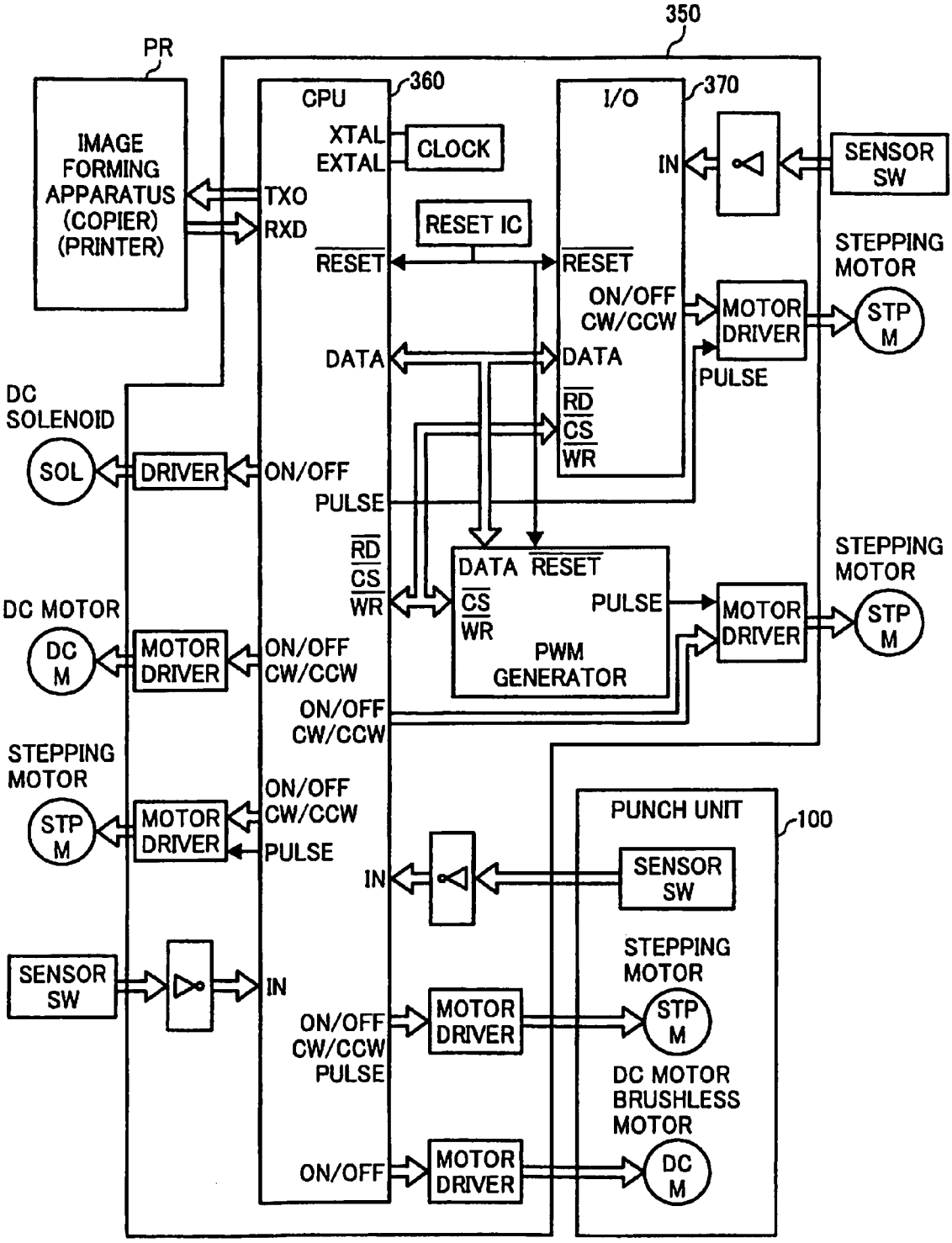
FIG. 33 is a block diagram of a control system configuration of the system according to the present embodiment.

FIG. 33 is a block diagram of a control system configuration of the entire system according to the present embodiment. As shown in FIG. 33, the control unit 350 of the sheet post-processing apparatus PD is a microcomputer including the CPU 360, an input/output (I/O) interface 370, and the like. A signal from each of switches of a control panel (not shown) included in a main body of the image forming apparatus PR and each of sensors such as the sheet-face detecting sensor 330 is input to the CPU 360 via the I/O interface 370. Based on the input signal, the CPU 360 controls the activation of the tray lifting motor 168 for the shift tray 202, the discharge guide-plate open/close motor 167 for opening/closing the openable guide plate 33, the shift motor 169 for moving the shift tray 202, a return-roller motor for driving the return roller 12, each of solenoids such as the tap solenoid 170, each of conveying motors for driving each of conveying rollers, each of sheet-discharge motors for driving each of sheet-discharge rollers, the discharge motor 157 for driving the discharge belt 52, the stapler travel motor 159 for moving the edge binding stapler S1, the oblique motor 160 for rotating the edge binding stapler S1 obliquely, the jogger motor 158 for moving the jogger fences 53, the stack branching drive motor 161 for turning the guide member 44, a stack conveying motor for driving the discharge roller 56 that conveys a stack of sheets, a trailing-end fence moving motor for moving the movable trailing-end fence 73, the folding-plate drive motor 166 for moving the folding plate 74, a folding-roller drive motor for driving the folding rollers 81, and the like. A pulse signal from a staple conveying motor (not shown) that drives the staple discharge rollers is input to the CPU 360, so that the CPU 360 counts up the number of pulses. Depending on the number of pulses, the CPU 360 controls the tap solenoid 170 and the jogger motor 158.

Incidentally, a control process as described below is performed based on a computer program in such a manner that the CPU 360 reads a program code stored in a read-only memory (ROM) (not shown) and uses a random access memory (RAM) (not shown) as a working area.

Figure 34:
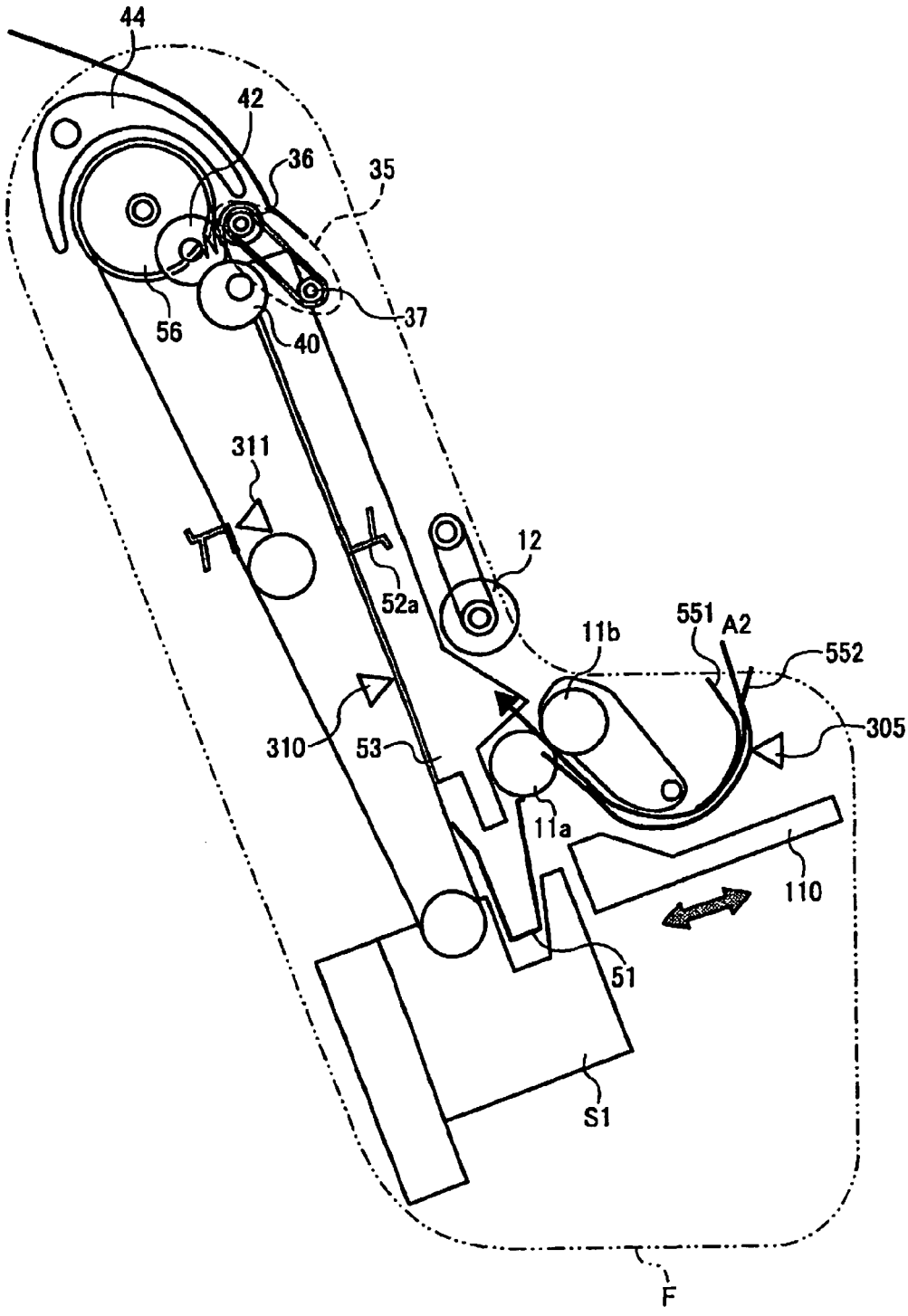
FIG. 34 is a front view of the edge-binding processing tray according to the present embodiment.

FIG. 34 is an enlarged front view of the edge-binding processing tray F shown in FIG. 1. The edge-binding processing tray F includes a staple discharge drive roller 11*a* and a staple discharge driven roller 11*b* as a sheet conveying member and guide plates 551 and 552 as a sheet guide member. As indicated by an arrow A2, a sheet is conveyed along the jogger fences 53 while the sheet is retained a posture constant in the edge-binding processing tray F. Incidentally, the guide plates 551 and 552 are respectively fixed to the edge-binding processing tray F.

Figure 35:
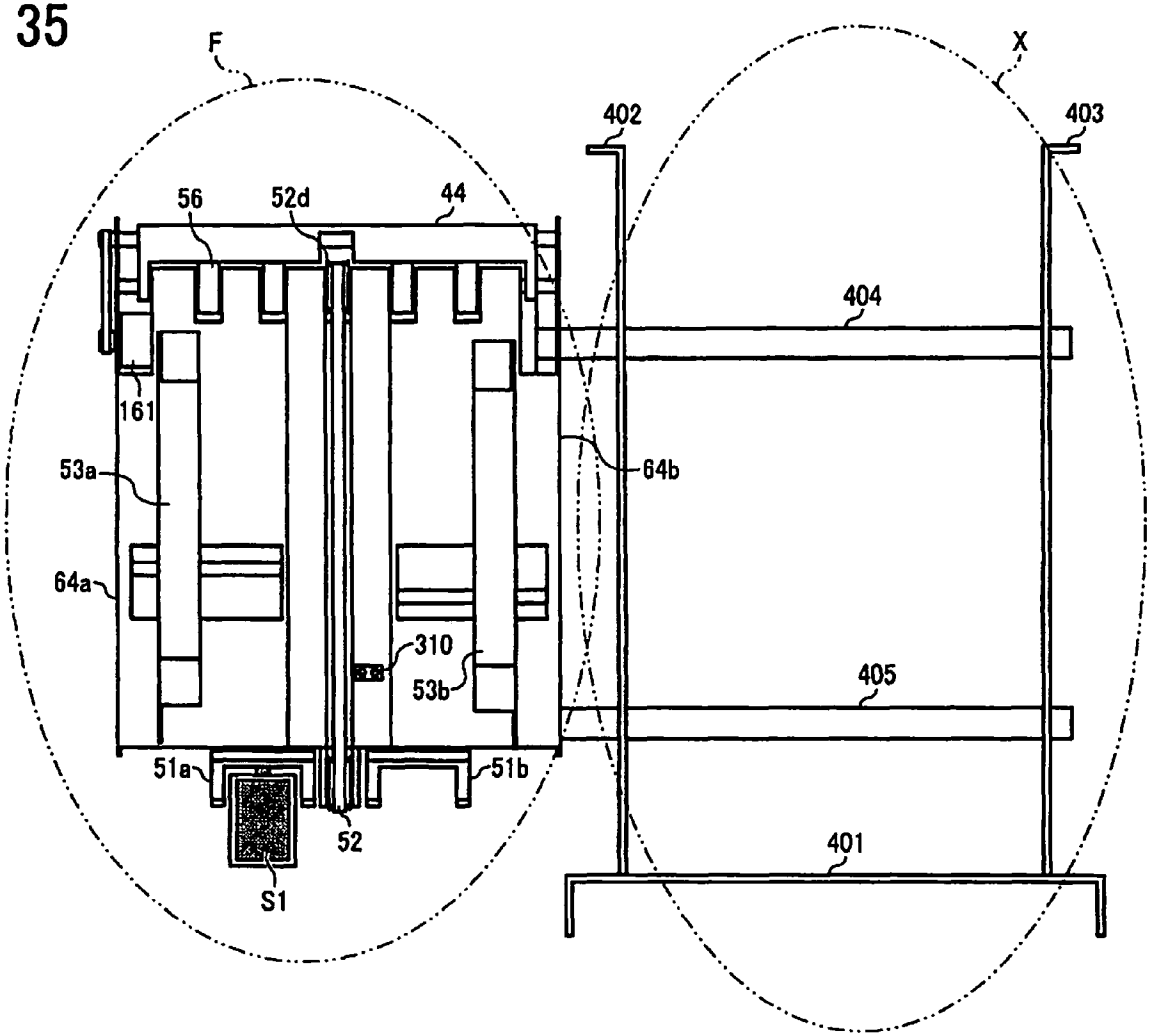
FIG. 35 is a plan view showing a state where the edge-binding processing tray shown in FIG. 34 is pulled out.
Figure 36:
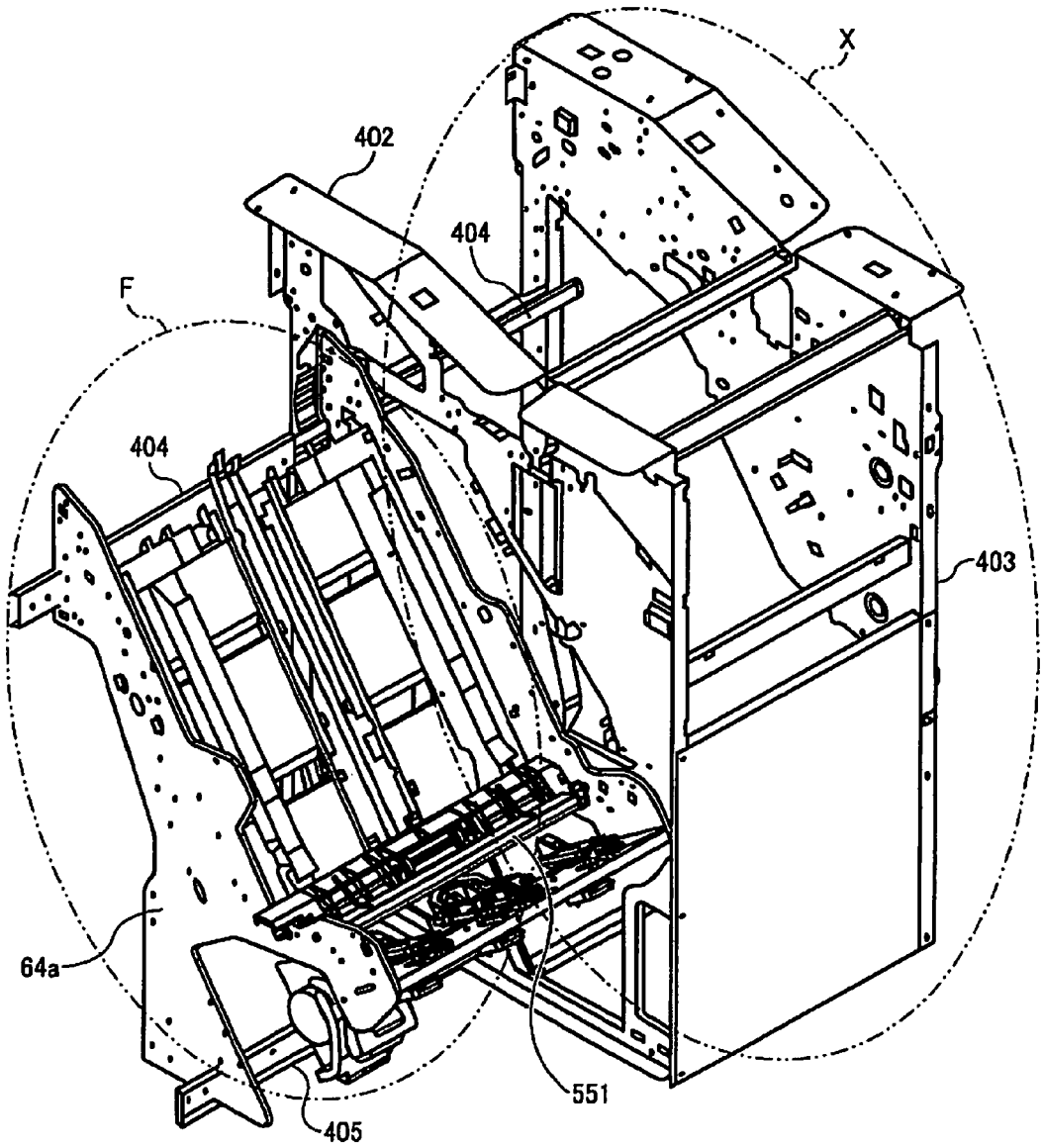
FIG. 36 is a perspective view showing a state where the edge-binding processing tray shown in FIG. 34 is pulled out.

FIG. 35 is a side view of the edge-binding processing tray F in a state where the edge-binding processing tray F is pulled out from a sheet processing device main body X. As shown in FIG. 35, the edge-binding processing tray F is slidably supported by a pair of upper and lower slide rails 404 and 405 provided between a front frame 402 and a back frame 403 of the sheet processing device main body X. The edge-binding processing tray F can be pulled out from the sheet processing device main body X up to a front end portion of the front frame 402 (a position of the edge-binding processing tray F shown in FIG. 35) as needed. Incidentally, the front frame 402 and the back frame 403 are arranged to project from a bottom frame 401 of the sheet processing device main body X. The edge-binding processing tray F is retractably supported by the upper and lower slide rails 404 and 405. FIG. 36 is a perspective view of the edge-binding processing tray F in the state shown in FIG. 35.

Figure 37:
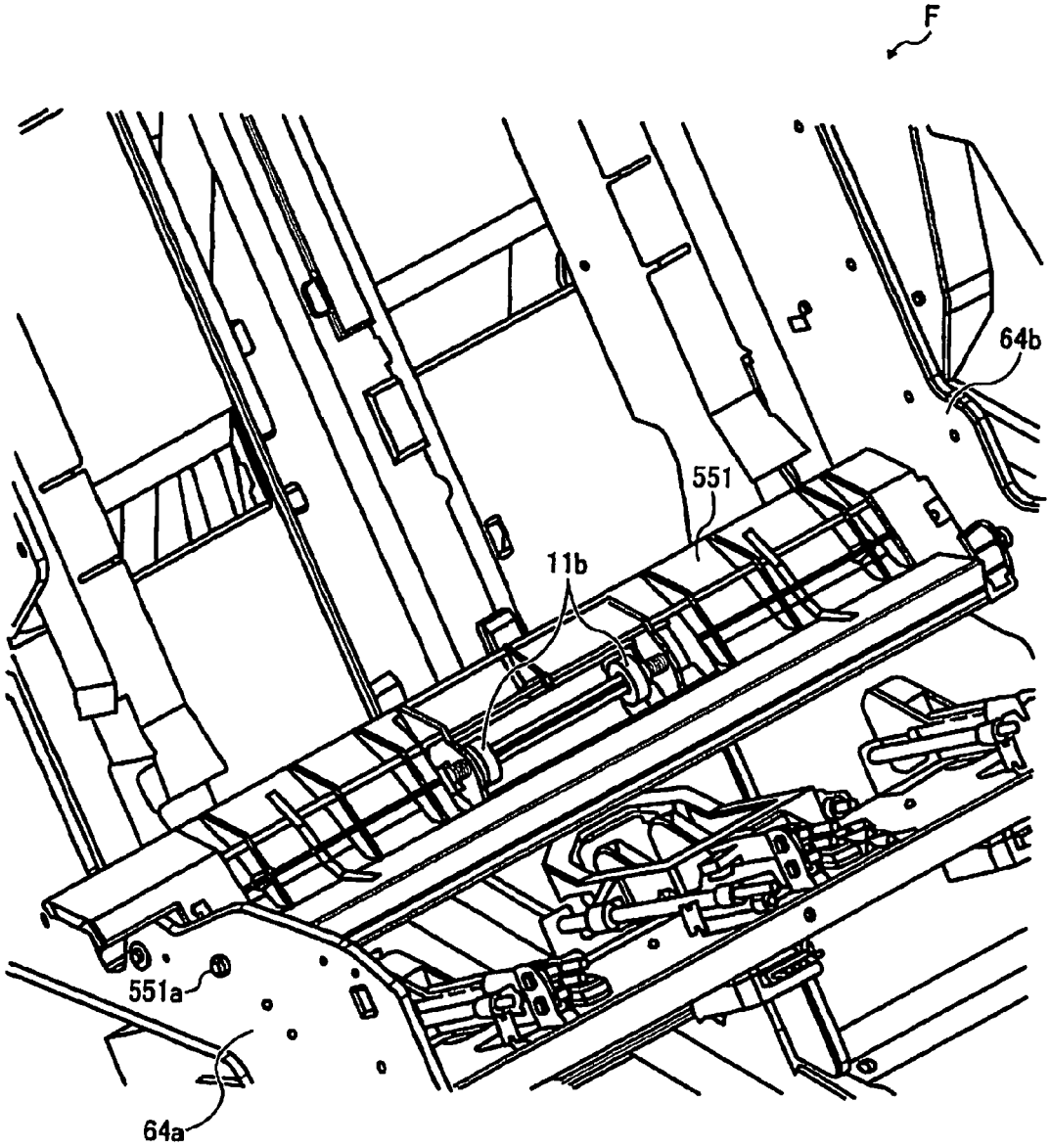
FIG. 37 is a perspective view of the guide plate in a normal (closed) state.
Figure 38:
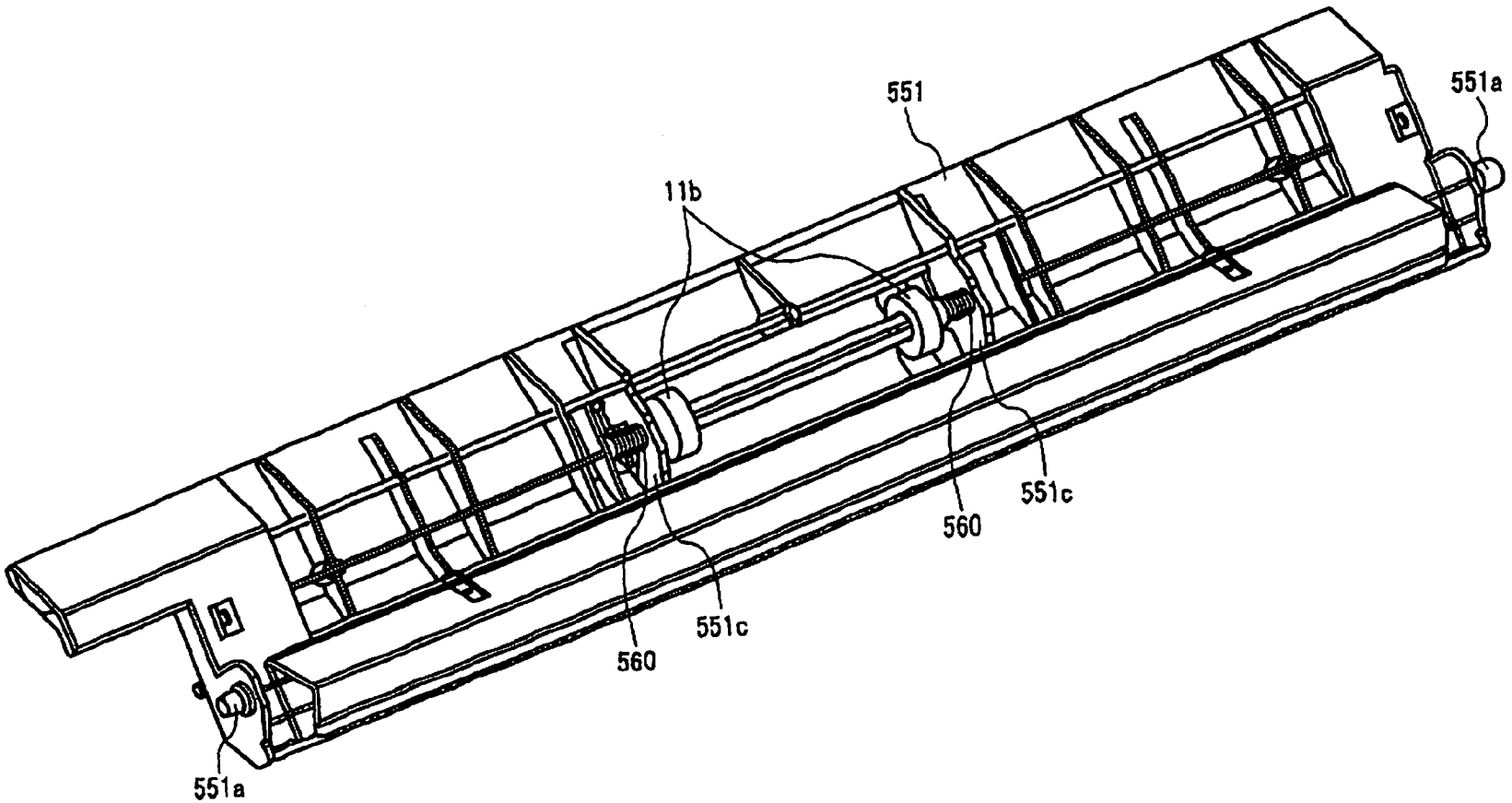
FIG. 38 is a detailed perspective view of the guide plate shown in FIG. 37.
Figure 40:
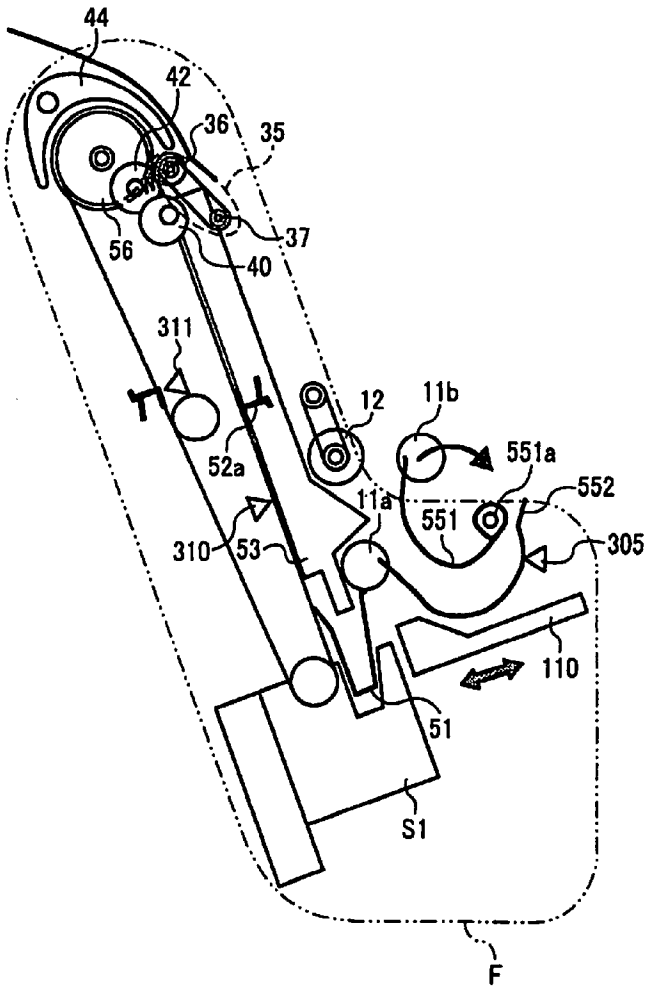
FIG. 40 is a schematic diagram of the guide plate in an opened state.
Figure 39:
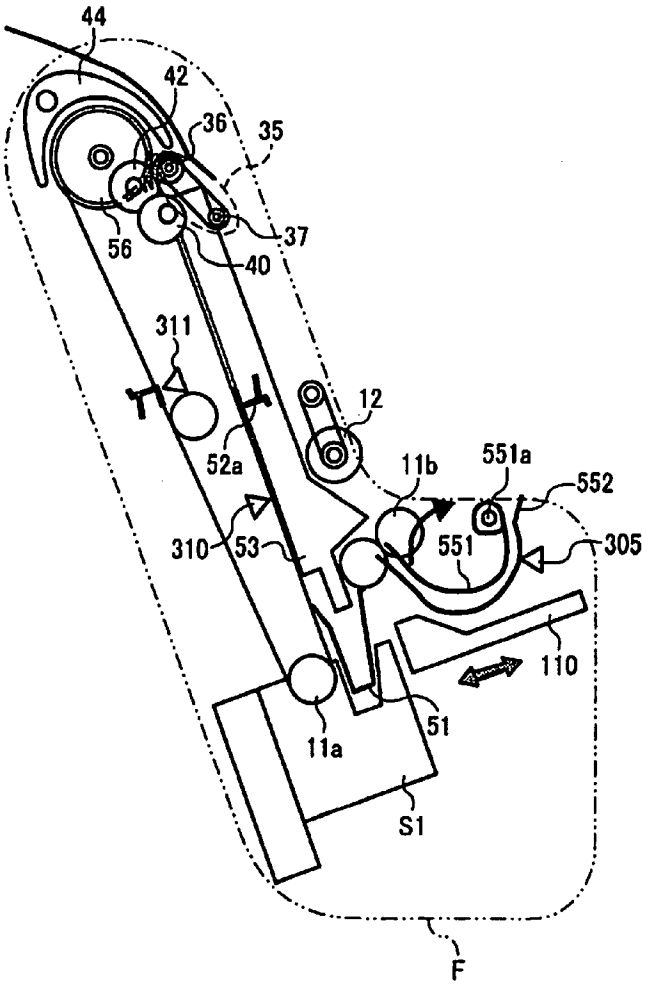
FIG. 39 is a schematic diagram of the guide plate in the normal (closed) state.
Figure 42:
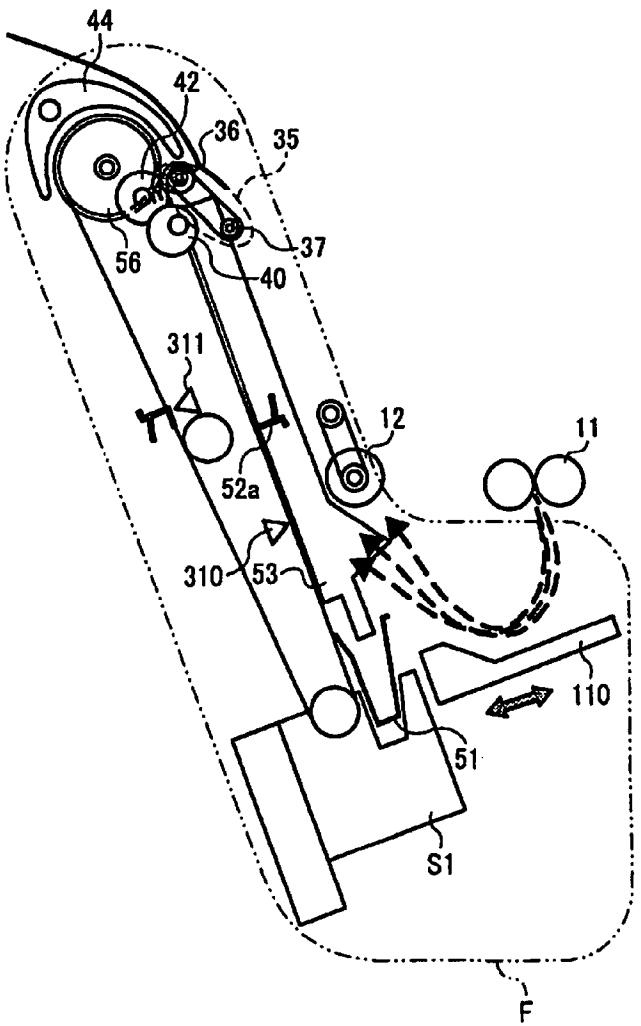
FIG. 42 is a front view of a staple processing tray according to a conventional technology.

FIGS. 37 to 40 are diagrams showing a modified example of the edge-binding processing tray F shown in FIG. 34. FIG. 37 is a perspective view showing the guide plate in a normal (closed) state. FIG. 38 is a detailed perspective view of the guide plate shown in FIG. 37. FIG. 39 is a schematic diagram of the guide plate for explaining the state where the guide plate is closed. FIG. 40 is a schematic diagram of the guide plate for explaining a state where the guide plate is opened. As shown in FIG. 39, in the modified example, the staple discharge driven roller 11*b* is attached to a portion between the front side plate 64*a* and the back side plate 64*b* of the edge-binding processing tray F via a supporting point (a supporting shaft) 551*a*. The staple discharge driven roller 11*b* is arranged on the side of a free end of the guide plate 551 that opens/closes (swings) around the supporting point 551*a*. The free end of the guide plate 551 is located on the upstream side of the trailing-end fence 51 in the sheet conveying direction. Therefore, when the guide plate 551 is opened as shown in FIG. 40, the pressure by the staple discharge driven roller 11*b* is released, and the staple discharge driven roller 11*b* moves away from the staple discharge drive roller 11*a* thereby forming a space between the staple discharge rollers 11*a* and 11*b*. The space is required in a jam fixing process. With such a configuration, even when a sheet jam occurs at an installation position of the staple discharge rollers 11*a* and 11*b*, the sheet jam can be easily fixed.

A predetermined pressure is applied to the staple discharge driven roller 11*b* by a compression spring 560 as a pressure applying unit (see FIG. 38), and thereby exerting a sheet conveying force on a portion between the staple discharge rollers 11*a* and 11*b*. The compression spring 560 is attached to an installation portion 551*c* of the guide plate 551. In the present embodiment, the guide plate 551 is an integral resin molding, so that the installation portion 551*c* is formed on a rib integrally-molded on the guide plate 551.

Incidentally, the staple discharge driven roller 11*b* is attached to the guide plate 551, and the guide plate 551 is attached to a portion between the front frame 402 and the back frame 403 of the edge-binding processing tray F. Therefore, when the edge-binding processing tray F including the trailing-end fence 51 is pulled out, the staple discharge driven roller 11*b* and the guide plate 551 are also pulled out integrally with the edge-binding processing tray F. A direction of pulling the edge-binding processing tray F is a longitudinal direction of the guide plate 551, so that the pulling direction is perpendicular to the sheet conveying direction.

Figure 41:
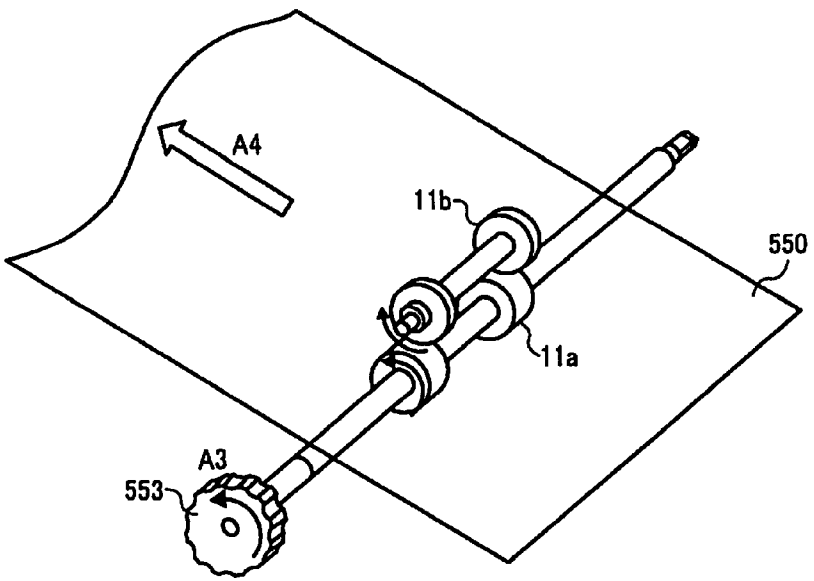
FIG. 41 is a perspective view showing an example where a knob is provided to a drive shaft of a staple discharge drive roller for fixing a sheet jam.

FIG. 41 shows another example of a configuration for fixing a sheet jam. In this example, a knob 553 is provided to a drive shaft of the staple discharge drive roller 11*a*. When a sheet jam occurs, the knob 553 is rotated in a direction of an arrow A3, so that a sheet 550 is conveyed in a direction of an arrow A4 so as to pull out the sheet 550 from the sheet processing device main body X. In other words, the knob 553 serves as a handle for rotating a sheet conveying member. When the sheet 550 is conveyed into the processing tray F, there is no sheet between the processing tray F and the sheet processing device main body X. Therefore, even when the edge-binding processing tray F is pulled out from the sheet processing device main body X as shown in FIGS. 35 and 36, there is no damage to the sheet.

In this manner, according to the present embodiment, the staple discharge rollers 11 (11*a* and 11*b*) are provided to the edge-binding processing tray F, so that a sheet entry into the edge-binding processing tray F can be reliably performed.

Specifically, the staple discharge rollers 11 (11*a* and 11*b*) are provided on the upstream side of the edge-binding processing tray F, so that the sheet entry into the edge-binding processing tray F can be reliably performed. Furthermore, the staple discharge rollers 11 (11*a* and 11*b*) are provided to the edge-binding processing tray F, so that the sheet entry into the edge-binding processing tray F can be stably performed. Moreover, the guide plates 551 and 552 are provided to the edge-binding processing tray F, so that a sheet conveyance to the edge-binding processing tray F can be reliably performed. In addition, the guide plates 551 and 552 are configured to be openable and closable, so that a sheet jam can be easily fixed. Furthermore, the knob 553 is provided to the staple discharge drive roller 11*a*, so that a sheet conveyance can be manually performed by rotating the knob 553, and thus a sheet jam can be easily fixed.

According to an aspect of the present invention, an entry of a sheet into a sheet aligning unit can be reliably performed, and a sheet jam occurring in the sheet aligning unit can be easily fixed.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A processing tray of a sheet processing device, the processing tray comprising:

a sheet aligning unit that aligns a sheet recording medium, a sheet conveying member at an inlet portion of the processing tray for conveying the sheet recording medium in an upward direction towards the alignment unit, wherein the processing tray and the sheet conveying member are configured to be pulled out from a main body of the sheet processing device, and a guide member at the inlet portion of the processing tray to guide the sheet recording medium to the conveying member, the guide member being configured to be pulled out from the main body of the sheet processing device with the processing tray.

2. The sheet processing tray according to claim 1, wherein the sheet aligning unit is slidably supported by a supporting member that is arranged in a direction perpendicular to a sheet conveying direction, and is pulled out in the direction perpendicular to the sheet conveying direction along the supporting member.

3. The processing tray according to claim 1, wherein the sheet conveying member is arranged on an upstream side of the sheet aligning unit in a sheet conveying direction.

4. The processing tray according to claim 1, further comprising a handle member for manually rotating the sheet conveying member to convey the sheet recording medium.

5. The processing tray according to claim 1, wherein, the guide member at the inlet portion of the processing tray receives the sheet recording medium traveling in a downward direction and redirects the sheet recording medium in the upward direction toward the conveying member, wherein the guide member includes a first guide plate and a second guide plate, the first guide plate being located above the sheet recording medium and being configured to be openable and closable with respect to a sheet conveying path.

6. The processing tray according to claim 1, wherein, the sheet conveying member includes a conveying drive roller and a conveying driven roller, wherein:

the guide member includes a first guide plate and a second guide plate, the first guide plate being located above a sheet conveying path of the sheet recording medium and being openable and closable with respect to the sheet conveying path, the second guide plate being located below the sheet conveying path at a fixed location on the processing tray, and the conveying drive roller is provided on the second guide plate, and the conveying driven roller is provided on the first guide plate.

7. The processing tray according to claim 1, wherein the sheet conveying member includes a conveying drive roller and a conveying driven roller, wherein:

the guide member includes a first guide plate and a second guide plate, the first guide plate being located above a sheet conveyance path of the sheet recording medium and being openable and closable with respect to the sheet conveying path, the second guide plate being located at a fixed location on the processing tray, the conveying drive roller is provided on the second guide plate, and the conveying driven roller is provided on the first guide plate, and an end portion of the first guide plate on a most upstream side in a sheet conveying direction is swingably supported by a supporting shaft.

8. The processing tray according to claim 1, wherein the sheet aligning unit further includes an edge binding unit that binds the sheet recording medium, the edge binding unit being located on a bottom portion of the sheet aligning unit.

9. The processing tray according to claim 1, further comprising:

an edge binding unit that binds the sheet recording medium, the edge binding unit being located on a bottom portion of the sheet aligning unit; and a carrying-out unit that carries out a stack of sheet recording media bound by the edge binding unit from the sheet aligning unit.

10. The processing tray according to claim 1, further comprising:

a carrying-out unit on the processing tray that carries out a stack of sheet recording media aligned by the sheet aligning unit from the sheet aligning unit, wherein the sheet process device further includes, a saddle-stitch binding unit that binds a center portion of the stack of sheet recording media carried out by the carrying-out unit; and a folding unit that folds the stack of sheet recording media bound by the saddle-stitch binding unit into two at a bound portion of the stack of sheet recording media.

11. The processing tray according to claim 1, wherein the sheet conveying member includes a conveying drive roller and a conveying driven roller, wherein:

the guide member includes a first guide plate and a second guide plate, the first guide plate being located above the sheet recording medium and being openable and closable with respect to a sheet conveying path, the second guide plate being located below the sheet conveying path at a fixed position on the processing tray, the conveying drive roller is provided on the second guide plate, and the conveying driven roller is provided on the first guide plate, an end portion of the first guide plate on a most upstream side in a sheet conveying direction is swingably supported by a supporting shaft, and the sheet aligning unit further includes an edge binding unit that binds a stack of sheet recording media, the edge binding unit being located on a bottom portion of the sheet aligning unit.

12. The processing tray according to claim 1, wherein the sheet conveying member includes a conveying drive roller and a conveying driven roller, wherein:

the guide member includes a first guide plate and a second guide plate, the first guide plate being located above a conveying path of the sheet recording medium and being openable and closable with respect to the sheet conveying path, the second guide plate being located at a fixed position on the processing tray, the conveying drive roller is provided on the second guide plate, and the conveying driven roller is provided on the first guide plate, an end portion of the first guide plate on a most upstream side in a sheet conveying direction is swingably supported by a supporting shaft, and the sheet aligning unit further includes an edge binding unit that binds a stack of sheet recording media, the edge binding unit being located on a bottom portion of the sheet aligning unit, and a carrying-out unit that carries out the stack of sheet recording media bound by the edge binding unit from the sheet aligning unit to an external device.

13. The sheet processing device according to claim 1, further comprising:

a first conveying path for discharging a conveyed sheet recording medium onto a discharge tray;

a second conveying path for discharging conveyed stacks of sheet recording media onto a shift tray by changing a direction of each of the stacks of sheet recording media alternately in a sheet conveying direction and a direction perpendicular to the sheet conveying direction; and a third conveying path for guiding a conveyed sheet recording medium to the sheet aligning unit.

14. The sheet processing device according to claim 1, further comprising:

a first conveying path for discharging a conveyed sheet recording medium onto a discharge tray;

a second conveying path for discharging conveyed stacks of sheet recording media onto a shift tray by changing a direction of each of the stacks of sheet recording media alternately in a sheet conveying direction and a direction perpendicular to the sheet conveying direction;

a third conveying path for guiding a conveyed sheet recording medium to the sheet aligning unit; and a fourth conveying path for guiding a stack of sheet recording media aligned by the sheet aligning unit to a center-folding processing unit.

15. The sheet processing device according to claim 1, further comprising:

a first conveying path for discharging a conveyed sheet recording medium onto a discharge tray;

a second conveying path for discharging conveyed stacks of sheet recording media onto a shift tray by changing a direction of each of the stacks of sheet recording media alternately in a sheet conveying direction and a direction perpendicular to the sheet conveying direction;

a third conveying path for guiding a conveyed sheet recording medium to the sheet aligning unit;

a fourth conveying path for guiding a stack of sheet recording media aligned by the sheet aligning unit to a center-folding processing unit; and a fifth conveying path for discharging the stack of sheet recording media center-folded by the center-folding processing unit onto a lower discharge tray.

16. An image forming apparatus comprising:

a sheet processing device including a processing tray with a sheet aligning unit that aligns a sheet recording medium, wherein the processing tray including, a sheet conveying member at an inlet portion of the processing tray for conveying the sheet recording medium in an upward direction towards the alignment unit, wherein the processing tray and the sheet conveying member are configured to be pulled out from a main body of the sheet processing device a first guide plate and a second guide plate at the inlet portion of the processing tray to receive the sheet recording medium traveling in a downward direction and to direct the sheet recording medium toward the conveying member, the guide plates being configured to be pulled out from the main body of the sheet processing device along with the processing tray, wherein the conveying member includes a driven roller connected to the first guide plate and a driving roller connected to the second guide plate, the driven roller and the first guide plate being openable and closable with respect to a sheet conveying path.

* * * * *